US006161347A

United States Patent [19]

Yu et al.

[11] Patent Number: 6,161,347

[45] **Date of Patent: *Dec. 19, 2000**

[54] PANEL ARRANGEMENT

[75] Inventors: X. Shawn Yu, Ottawa; Bryan R. Gingrich, Holland; Robert L. Tuttle, Saugatuck; Keith Foco, Holland, all of Mich.

[73] Assignee: Haworth, Inc., Holland, Mich.

[ * ] Notice: This patent is subject to a terminal disclaimer.

[21] Appl. No.: 09/220,169

[22] Filed: Dec. 23, 1998

Related U.S. Application Data

[63] Continuation of application No. 08/736,512, Oct. 24, 1996, Pat. No. 5,852,904, which is a continuation-in-part of application No. 08/692,344, Aug. 5, 1996, abandoned.

[51] Int. Cl.[7] ..... E04B 2/74

[52] U.S. Cl. ..... 52/220.7; 52/36.4

[58] Field of Search ..... 52/220.7, 36.1, 52/36.4, 239; 312/223.1, 223.6, 223.3; 439/215, 216, 209

[56] References Cited

U.S. PATENT DOCUMENTS

| | | |
|---|---|---|
| Re. 27,215 | 11/1971 | Propst et al. . |
| Re. 32,890 | 3/1989 | DeFouw et al. . |
| 1,176,692 | 3/1916 | Smith . |
| 1,854,314 | 4/1932 | Ryan . |
| 1,981,240 | 11/1934 | McNeil . |
| 2,114,388 | 4/1938 | Killion . |
| 2,187,408 | 1/1940 | Thumm . |
| 2,969,565 | 1/1961 | Levy . |
| 3,195,698 | 7/1965 | Codrea . |
| 3,255,563 | 6/1966 | Sauer . |
| 3,316,624 | 5/1967 | Brudevold . |
| 3,377,756 | 4/1968 | Polhamus . |
| 3,428,108 | 2/1969 | Singer . |
| 3,461,349 | 8/1969 | Meyer . |
| 3,462,892 | 8/1969 | Meyer . |

(List continued on next page.)

FOREIGN PATENT DOCUMENTS

| | | |
|---|---|---|
| 73715/74 | 1/1976 | Australia . |
| 2 075 014 | 2/1993 | Canada . |
| 2 662 216 | 11/1991 | France . |
| 680 980 A5 | 12/1992 | Switzerland . |
| 1 563 890 | 4/1980 | United Kingdom . |
| 2 247 257 | 2/1992 | United Kingdom . |
| 2 250 759 | 6/1992 | United Kingdom . |

OTHER PUBLICATIONS

Article "Innovative construction sets Office Specialty's Platform panel system apart" by Marilyn Zelinsky, Jun. 1995 (2 pages).

Steelcase brochure Montage Product Overview, 1994 (13 pages).

Teknion Furniture Systems Inc. brochure entitled "3 reasons why Teknion could change your mind about office furniture systems.", 1982 (8 pages).

*Primary Examiner*—Michael Safavi

*Attorney, Agent, or Firm*—Flynn, Thiel, Boutell & Tanis, P.C.

[57] ABSTRACT

A space-dividing wall panel system having a plurality of base panels which are serially connectable one with the other to define a vertically enlarged wall supported on a floor. Each base panel is defined by at least one horizontal box-beam rigidly connected to a pair of laterally spaced apart vertical uprights which are connected at the opposite ends of the box-beam and have a reduced thickness compared thereto. With this clearance between the faces of the box-beam and the uprights, the box-beam, cross rails at the ends of the uprights as well as additional extension panels are formed with longitudinally extending channels which are positioned free of interference with the vertical uprights and aligned with serially-adjacent channels of serially-adjacent wall panels. The channels provide a continuous linear track on the opposite sides of the upright which permit the connection of mounting hooks of furniture components and permit continuous, uninterrupted sliding or adjustment of the furniture components along the entire length of the aligned channels.

20 Claims, 27 Drawing Sheets

U.S. PATENT DOCUMENTS

| | | |
|---|---|---|
| 3,553,916 | 1/1971 | Lickliter et al. . |
| 3,567,842 | 3/1971 | Meyer . |
| 3,585,768 | 6/1971 | Klein . |
| 3,675,382 | 7/1972 | Lickliter et al. . |
| 3,749,432 | 7/1973 | Janssen . |
| 3,771,277 | 11/1973 | Rausch et al. . |
| 3,802,146 | 4/1974 | Tacke et al. . |
| 3,814,833 | 6/1974 | Yamada et al. . |
| 3,823,251 | 7/1974 | Heithecker et al. . |
| 3,831,330 | 8/1974 | Tacke et al. . |
| 3,834,093 | 9/1974 | Tacke et al. . |
| 3,856,981 | 12/1974 | Boundy . |
| 3,862,524 | 1/1975 | McCrackin . |
| 3,909,502 | 9/1975 | Lacan . |
| 3,916,972 | 11/1975 | Breiner . |
| 4,021,973 | 5/1977 | Hegg et al. . |
| 4,032,821 | 6/1977 | Keiser . |
| 4,047,342 | 9/1977 | Boulva . |
| 4,056,297 | 11/1977 | Gartung . |
| 4,057,123 | 11/1977 | Erickson . |
| 4,164,618 | 8/1979 | Casasanta . |
| 4,197,685 | 4/1980 | Goulish et al. . |
| 4,200,254 | 4/1980 | Nelson . |
| 4,203,639 | 5/1980 | VandenHoek et al. . |
| 4,218,579 | 8/1980 | Joly . |
| 4,229,917 | 10/1980 | Textoris et al. . |
| 4,255,611 | 3/1981 | Propst et al. . |
| 4,257,203 | 3/1981 | Propst et al. . |
| 4,269,005 | 5/1981 | Timmons . |
| 4,278,834 | 7/1981 | Boundy . |
| 4,284,840 | 8/1981 | Baker . |
| 4,353,411 | 10/1982 | Harter et al. . |
| 4,370,008 | 1/1983 | Haworth et al. . |
| 4,375,010 | 2/1983 | Mollenkopf . |
| 4,377,724 | 3/1983 | Wilson . |
| 4,391,073 | 7/1983 | Mollenkopf et al. . |
| 4,395,854 | 8/1983 | White et al. . |
| 4,404,776 | 9/1983 | Ball et al. . |
| 4,443,986 | 4/1984 | Propst et al. . |
| 4,448,003 | 5/1984 | Hasbrouck . |
| 4,457,117 | 7/1984 | Leiher et al. . |
| 4,477,128 | 10/1984 | Hasbrouck . |
| 4,516,619 | 5/1985 | Hasbrouck . |
| 4,535,577 | 8/1985 | Tenser et al. . |
| 4,567,698 | 2/1986 | Morrison . |
| 4,571,907 | 2/1986 | DeFouw et al. . |
| 4,601,137 | 7/1986 | Bates . |
| 4,601,145 | 7/1986 | Wilcox . |
| 4,619,486 | 10/1986 | Hannah et al. . |
| 4,625,483 | 12/1986 | Zacky et al. . |
| 4,631,881 | 12/1986 | Charman . |
| 4,642,418 | 2/1987 | Menchetti . |
| 4,685,255 | 8/1987 | Kelley . |
| 4,712,336 | 12/1987 | Backer . |
| 4,716,698 | 1/1988 | Wilson et al. . |
| 4,771,583 | 9/1988 | Ball et al. . |
| 4,802,422 | 2/1989 | Beard . |
| 4,821,477 | 4/1989 | Rydgvist . |
| 4,831,791 | 5/1989 | Ball . |
| 4,833,848 | 5/1989 | Guerin . |
| 4,852,317 | 8/1989 | Schiavello et al. . |
| 4,874,027 | 10/1989 | Boundy et al. . |
| 4,876,835 | 10/1989 | Kelley et al. . |
| 4,881,349 | 11/1989 | Brown et al. . |
| 4,881,352 | 11/1989 | Glockenstein . |
| 4,882,885 | 11/1989 | Chatterson et al. . |
| 4,891,920 | 1/1990 | Pingston . |
| 4,899,018 | 2/1990 | Sireci . |
| 4,914,873 | 4/1990 | Newhouse . |
| 4,931,597 | 6/1990 | Kimbrough et al. . |
| 4,932,177 | 6/1990 | Hinden . |
| 4,936,066 | 6/1990 | Rütsche et al. . |
| 4,962,805 | 10/1990 | Allen . |
| 4,967,531 | 11/1990 | Giles et al. . |
| 4,976,080 | 12/1990 | Zegel et al. . |
| 4,996,811 | 3/1991 | Dull et al. . |
| 5,004,371 | 4/1991 | Sorensen . |
| 5,013,112 | 5/1991 | Hellwig . |
| 5,024,030 | 6/1991 | Morrison . |
| 5,038,539 | 8/1991 | Kelley et al. . |
| 5,056,577 | 10/1991 | DeLong et al. . |
| 5,058,331 | 10/1991 | Epps . |
| 5,058,347 | 10/1991 | Schuelke et al. . |
| 5,062,246 | 11/1991 | Sykes . |
| 5,065,556 | 11/1991 | DeLong et al. . |
| 5,069,263 | 12/1991 | Edwards . |
| 5,081,808 | 1/1992 | Bastian et al. . |
| 5,094,053 | 3/1992 | Militzer . |
| 5,101,606 | 4/1992 | Meru . |
| 5,116,235 | 5/1992 | Nienhuis et al. . |
| 5,129,835 | 7/1992 | DeFouw et al. . |
| 5,134,826 | 8/1992 | La Roche et al. . |
| 5,155,955 | 10/1992 | Ball et al. . |
| 5,155,960 | 10/1992 | Shaanan . |
| 5,172,529 | 12/1992 | Van De Riet . |
| 5,175,969 | 1/1993 | Knauf et al. . |
| 5,187,912 | 2/1993 | Hsueh . |
| 5,195,286 | 3/1993 | DeLong et al. . |
| 5,195,287 | 3/1993 | Bruggink . |
| 5,207,041 | 5/1993 | Wills . |
| 5,209,035 | 5/1993 | Hodges et al. . |
| 5,211,502 | 5/1993 | Upham-Hill . |
| 5,214,889 | 6/1993 | Nienhuis et al. . |
| 5,214,890 | 6/1993 | Levitan et al. . |
| 5,216,859 | 6/1993 | Moreno et al. . |
| 5,224,673 | 7/1993 | Webb . |
| 5,228,254 | 7/1993 | Honeycutt, Jr. . |
| 5,241,796 | 9/1993 | Hellwig et al. . |
| 5,251,413 | 10/1993 | Goodman . |
| 5,274,970 | 1/1994 | Roberts . |
| 5,277,005 | 1/1994 | Hellwig et al. . |
| 5,277,006 | 1/1994 | Ruster . |
| 5,277,007 | 1/1994 | Hellwig et al. . |
| 5,287,666 | 2/1994 | Frascaroli et al. . |
| 5,287,909 | 2/1994 | King et al. . |
| 5,325,649 | 7/1994 | Kajiwara . |
| 5,326,934 | 7/1994 | LeMaster et al. . |
| 5,337,525 | 8/1994 | Zaccai et al. . |
| 5,341,615 | 8/1994 | Hodges et al. . |
| 5,347,778 | 9/1994 | Bray . |
| 5,357,055 | 10/1994 | Sireci . |
| 5,362,923 | 11/1994 | Newhouse et al. . |
| 5,363,612 | 11/1994 | Erickson . |
| 5,370,488 | 12/1994 | Sykes . |
| 5,381,994 | 1/1995 | Welch . |
| 5,394,658 | 3/1995 | Schreiner et al. . |
| 5,400,560 | 3/1995 | Hellwig et al. . |
| 5,403,232 | 4/1995 | Helm et al. . |
| 5,406,760 | 4/1995 | Edwards . |
| 5,426,904 | 6/1995 | Gilmore . |
| 5,428,928 | 7/1995 | Hellwig et al. . |
| 5,465,541 | 11/1995 | Lin et al. . |
| 5,474,402 | 12/1995 | Wu . |
| 5,479,747 | 1/1996 | Wu . |
| 5,487,246 | 1/1996 | Hodges et al. . |
| 5,490,357 | 2/1996 | Lin . |
| 5,491,943 | 2/1996 | Vondrejs et al. . |
| 5,502,930 | 4/1996 | Burkette et al. . |
| 5,560,418 | 10/1996 | Kissinger . |
| 5,561,960 | 10/1996 | Minnick et al. . |
| 5,675,949 | 10/1997 | Forslund et al. . |
| 5,740,650 | 4/1998 | Seiber et al. . |
| 5,746,034 | 5/1998 | Luchetti et al. . |
| 5,746,035 | 5/1998 | Seiber et al. . |
| 5,826,385 | 10/1998 | Dykstra et al. . |
| B1 4,224,769 | 5/1990 | Ball et al. . |
| B1 4,876,835 | 6/1992 | Kelly et al. . |

128
19-1
129
130
134
134
133
127
127
17-1
54-1
18-1
126
126
46-1
125
126
134
51-1
134
133
51-1
135
135

56-1
40-1
19-1
56-1
135'
124
124
17-1
124
124
119
55-1
55-1
120
123
123
42-1
135'
56-1
56-1
40-1
19-1

76-1
78-1
24-1
81-1
81-1
144
146
145
79-1
147
145
78-1
76-1

PANEL ARRANGEMENT

This is a continuation of Ser. No. 08/736,512, filed Oct. 24, 1996, now U.S. Pat. No. 5,852,904, which is a continuation-in-part of Ser. No. 08/692,344, now abandoned filed Aug. 5, 1996. These prior applications are incorporated herein by reference.

FIELD OF THE INVENTION

This invention relates to a space-dividing wall panel system formed from upright panels and, more specifically, to a wall panel system defining an improved load-bearing and cable-carrying "spine" wall to which return walls are connected to define individual workstations.

BACKGROUND OF THE INVENTION

Commercial buildings typically include large open office areas which are divided into smaller work spaces or workstations by any of a number of space divider and panel systems that have been developed therefor. These space divider arrangements typically employ upright space-dividing wall panels which serially connect together to subdivide the office area into a plurality of smaller workstations of desired size and configuration. Such panels are typically less than floor-to-ceiling height, and cooperate with other furniture components to define an equipped workstation. These components may include work surfaces, file cabinets, shelf units and the like which mount directly on and are supported by the wall panels, and may also include free-standing furniture components such as tables, chairs and file cabinets.

In subdividing open office areas into individual workstations, the individual wall panel assemblies have a variety of constructions. Typically, a plurality of upright space-dividing wall panels are employed which serially connect together through two-panel straight or angled connections, or through suitable three or four-panel connections, to subdivide the office area into the plurality of smaller workstations.

In one type of arrangement, a common panel construction is used to construct all of the walls of the workstations whereby each panel is individually connectable with serially adjacent panels through the aforementioned straight or corner connections. With such an arrangement, a group of workstations can be formed, for example, with a common central section of wall panels separating one row of workstations on one side of the central section from a separate row of workstations formed on the opposite side thereof.

Since each workstation usually requires power as well as communications capability such as for computers and telephones or the like, the wall panels preferably have power and telecommunications cabling within interior raceways thereof. Typically the central wall section formed by the wall panels carries the greatest number of cables since it provides access to all or most of the adjacent workstations formed on opposite sides thereof. In such an arrangement, however, the wall panels typically have a relatively narrow thickness to minimize the floor space being used and thereby have a limited cabling capacity. As a result, it may become difficult to accommodate all of the power and telecommunication cabling for all of the workstations associated with a particular group of workstations. Additionally, the central wall section also supports furniture components for the multiple workstations.

To provide an expanded capacity for the space dividing panels, a second type of space divider system is known which utilizes interconnected beams or wall panels having an increased cabling capacity to form a central divider wall. This increased capacity divider wall typically runs the length of a group of workstations and is commonly referred to as a "spine" wall. Such spine walls also provide an increased load-bearing capacity for readily supporting and mounting thereon furniture components of individual workstations.

In one known spine-type space dividing arrangement as disclosed in U.S. Pat. No. 5,155,955 (Ball et al), an office space dividing system is provided where rectangular structural frames are formed of vertical mitered stiles having a vertically enlarged horizontal base rail proximate the lower ends of the mitered stiles and additional horizontal cross rails are disposed thereabove. The frames are connected with adjacent frames such that vertical columns are formed by the mitered stiles. Cabling is accommodated within each frame such that the communication cabling extends vertically through the mitered stiles in the region between the serially-adjacent frames and horizontally through passageways formed through the mitered stiles. This arrangement, however, requires the removal of furniture components when moving these components between panels and also routes horizontal cabling through the posts which thereby makes reconfiguration of workstations more difficult.

In a further spine wall arrangement as disclosed in U.S. Pat. No. 4,831,791 (Ball), a plurality of interconnected beams disposed at work surface height are supported by vertical posts at the opposite ends thereof, which beams have a hollow interior in which cabling is accommodated. Such interconnected beams have stabilizer beams extending sidewardly therefrom which are connectable in the region intermediate the support posts. Additional patents relating to this particular arrangement are U.S. Pat. Nos. B1 4,224,769, 4,404,776 and 4,771,583. This arrangement also requires removal of furniture components when moving these components between wall sections.

In view of the foregoing, it is an object of the invention to provide a readily reconfigurable space-dividing wall panel system having base panels supported on a floor and a vertically adjustable modular height which is adjusted by the addition or removal of extension panels onto or off of the lower base wall panels. It is a further object that the wall panel system accommodate a variety of workstation components such as shelves and desks as well as return walls. It is still a further object that the panel system permit continuous off-modular adjustment of the furniture components or return walls connected thereto to minimize reconfiguration costs wherein continuous off-modularity refers to the ability to adjust the position of the return walls and furniture components not only continuously along the length of each individual wall panel but also continuously between serially-adjacent wall panels without interruption.

It is also an object that electrical and/or telecommunication cabling be laid into the wall panels over vertical posts therein without routing through the posts. It is further an object that the cabling be readily accommodated and accessible in a base raceway or a beltline raceway whereby the raceway cabling is routable both vertically within the base panel between the base and beltline raceways, and horizontally through horizontally adjacent raceways of serially-adjacent panels. It is still a further object that the base and beltline raceways be accessible along the length of a wall panel arrangement with individual receptacles being continuously relocatable along the length of each panel.

It is another object of the invention to provide wall panels and in particular, base panels supported on the floor which have an increased load-bearing capacity so as to accommodate the furniture components of a large number of workstations. It is an object that such load-bearing capacity readily handle the loads associated with the individual furniture components supported on the base panel, as well as the loads transferred thereto by return walls which are connected to the base panel and are loaded with their own furniture components and equipment.

In view thereof, the present invention relates to a space-dividing wall panel system and in particular, a spine wall system having a plurality of base panels which are serially connectable one with the other so as to define a vertically enlarged wall supported on a floor. Preferably each base panel has a rectangular frame which includes at least one horizontal composite box-beam and a pair of laterally spaced apart vertical uprights rigidly connected at the opposite ends of the box-beam. The box-beam is connected either intermediate the opposite upper and lower ends of the vertical uprights or alternatively, at one of the ends of the vertical uprights. The free ends of the vertical uprights have horizontal cross rails connected thereto which are vertically spaced from the box-beam to define cavities therebetween.

The box-beam is vertically enlarged and has a height which is a substantial portion of the height of the vertical uprights such that the connection of the box-beam to the vertical uprights provides a structurally strong and rigid connection therebetween. Additionally, the outer faces of the box-beam and the outward faces of the vertical uprights are thereby spaced sidewardly one from the other so as to define a clearance space therebetween.

To permit the connection of furniture components, the box-beam as well as the cross rails are formed with longitudinally extending horizontal channels, which channels are positioned outwardly of the uprights on the opposite sides thereof. The channels are free of interference with the vertical uprights while extending to the opposite ends of the base panel to thereby align with corresponding channels on a serially-adjacent base panel. The aligned channels define a continuous linear track preferably along the entire linear length of the spine wall system. The channels or more specifically, the tracks accommodate appropriate mounting hooks of furniture components such as return walls to fixedly secure the components to the base panel while permitting continuous, uninterrupted sliding or adjustment of the furniture components along the entire linear length of the track. Such an arrangement thus provides continuous off-modularity for the furniture components including the return walls.

To accommodate cabling therein, the cavities above and below the box-beam define respective beltline and base raceways which communicate with adjacent raceways of serially-adjacent base panels by the clearance space formed adjacent the uprights. The cabling is laid in the raceways and passes around the uprights. Additionally, horizontally relocatable receptacles are provided which connect to the cabling and are adapted to be horizontally adjustable along the length of each individual base panel. Such receptacles preferably are either mounted to an elongate mounting rail connected between the uprights so as to be horizontally movable within the confines of the raceways, or alternatively are disposed on the exterior of the base panel while being connected to the slide rail or the continuous track to permit horizontal sliding of the receptacle therealong.

Typically the box-beam has finished outer surfaces which are adapted to be flush with removable cover panels which enclose the beltline and base raceways so that a space or passage is provided between the cover panel and the uprights through which the cabling passes. Additionally, adjacent horizontal edges of the cover panels and the box-beam surfaces are vertically spaced apart to define a horizontal gap which opens into the beltline and base raceways and permits routing of cabling into and out of the raceways. Such cabling can be extended either to office equipment positioned within the workstation or into an adjacent end of a return wall which is mounted to the base panel.

Further, to allow for modular adjustment of the height of the wall panels, extension panels are mountable on the base panels, such as by a bayonet connection, so as to extend vertically above the base panel. The extension panel can be formed with two vertical uprights having either an additional box-beam connected therebetween for significant structural strength or additional cross rails connected therebetween so as to define a substantially rectangular frame which is attachable to the upper end of the base panels. The additional box-beam or the cross rails of the extension panel similarly are formed with channels along the length thereof which are free of interference with the uprights thereof so as to define additional continuous off-modular tracks extending along the linear length of a wall panel arrangement.

Other objects and purposes of the invention, and variations thereof, will be apparent upon reading the following specification and inspecting the accompanying drawings.

Figure 1A:
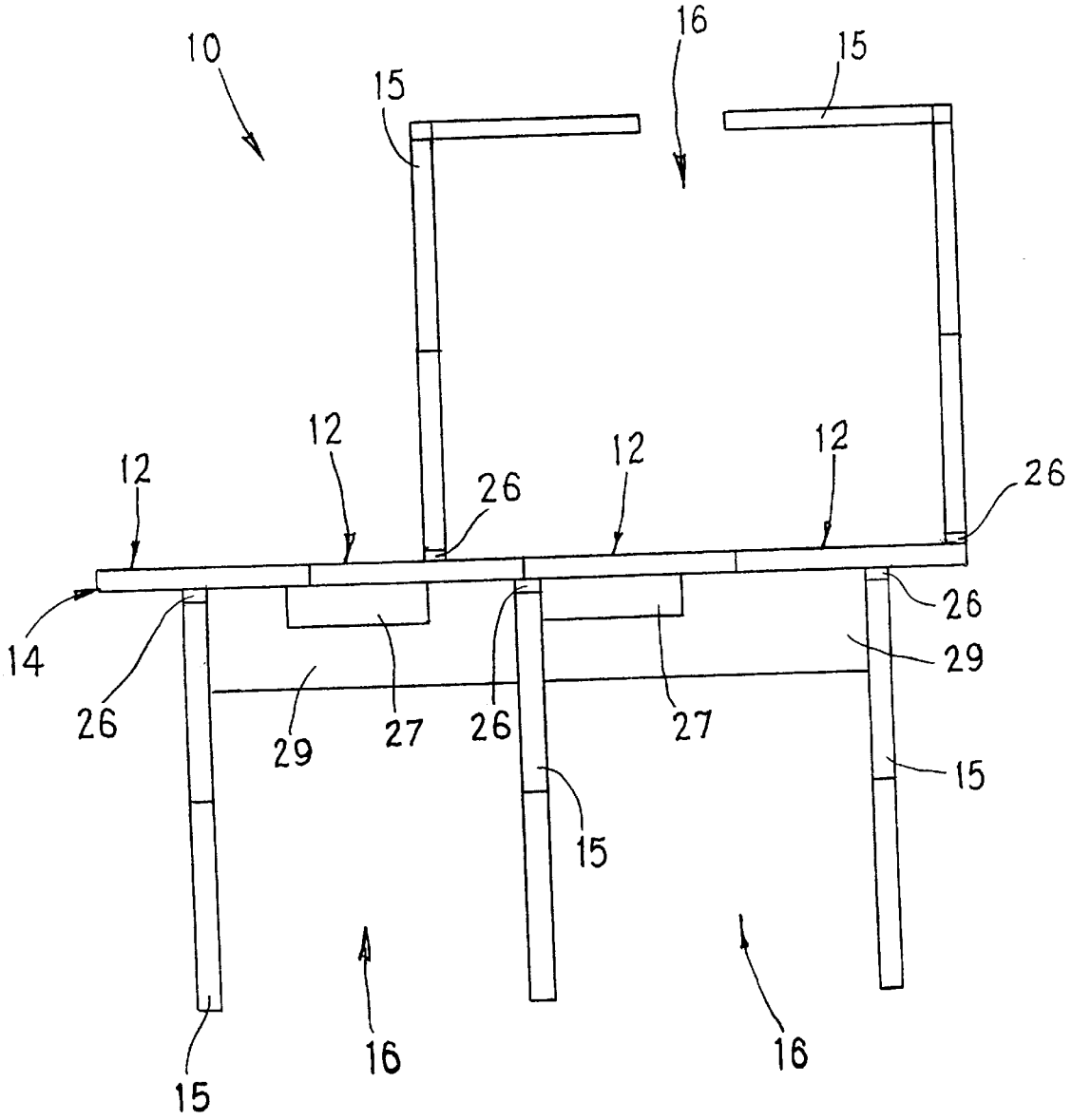
FIG. 1A is a top plan view illustrating a first embodiment of a space-dividing wall panel system of the invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 1B:
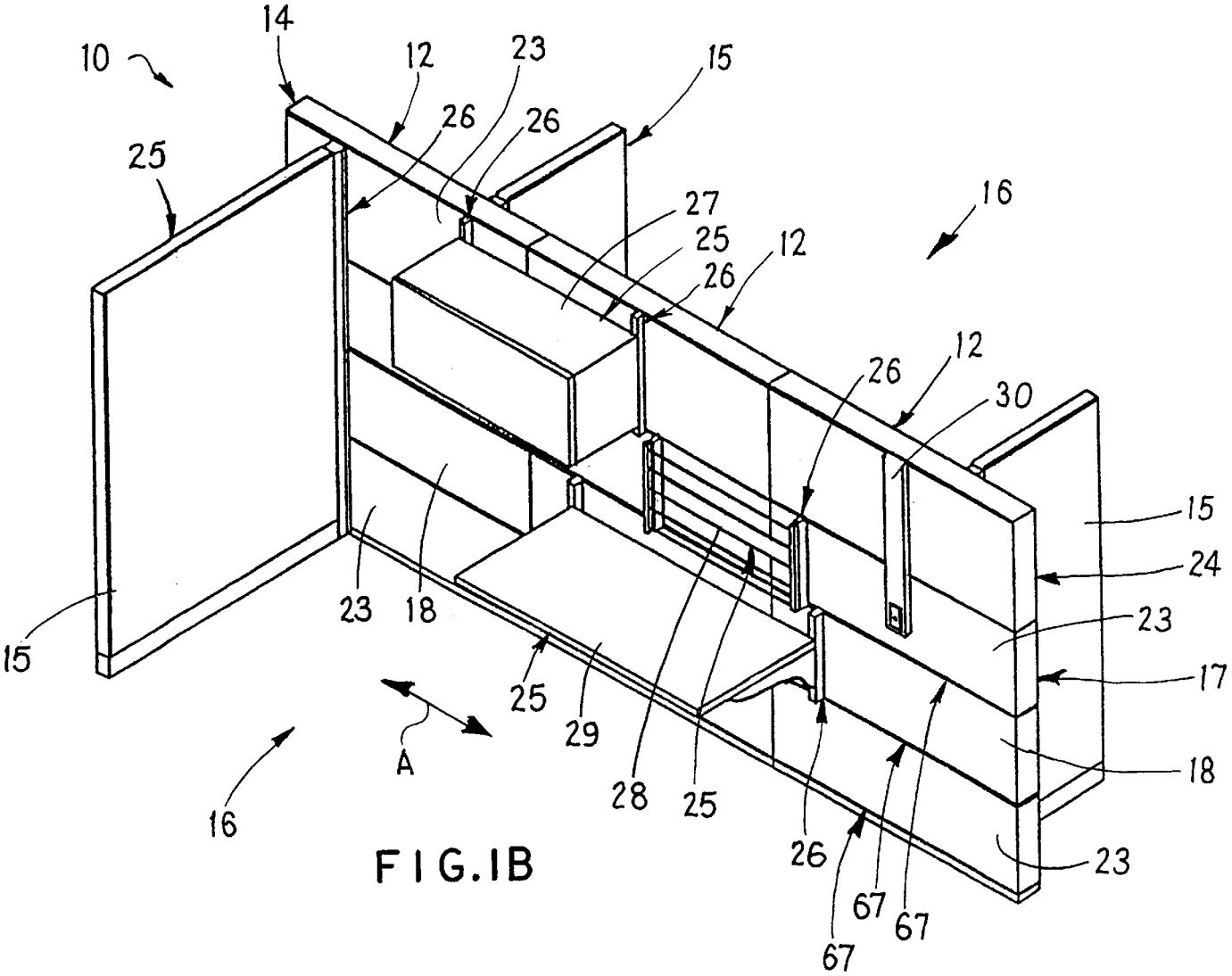
FIG. 1B is a front perspective view illustrating one configuration of the space-dividing wall panel system of the invention.

Referring to FIGS. 1A and 1B, the invention generally relates to a space-dividing wall panel system 10 for subdividing an office area. The wall panel system 10 includes a selected number of upstanding wall panel assemblies 12 horizontally serially connected, for example, in straight configurations so as to define a primary space-dividing wall 14 having substantial load-bearing and cable-carrying capacities. The wall 14 is commonly referred to as a "spine wall", and typically is provided in combination with return walls 15 for subdividing the office area into separate workstations 16.

To accommodate substantial loads and cabling, the wall panel assemblies 12 of the invention include base panels 17 (FIGS. 5 and 6A) which each include an enlarged horizontally extending box-like cross beam 18 connected between vertical uprights 19. The base panels 17 define horizontal raceways 21 and 22 (FIG. 5) respectively above and below the box-beam 18, which raceways are enclosed by removable panel covers or tiles 23. The wall panel assemblies 12 also support extension or add-on panels 24 thereon as well as furniture components 25. The construction of the wall panel assemblies 12 permits continuous off-modular adjustment of furniture or workstation components 25 along the spine wall 14, wherein "continuous off-modularity" refers to the ability to adjust the position of the return walls 15 and other furniture components 25 not only continuously along the length of each individual wall panel assembly 12 but also continuously between serially-adjacent wall panel assemblies 12 without interruption.

The inventive wall panel system is diagrammatically illustrated in and described with respect to FIGS. 1–7. In particular, FIGS. 1–7 illustrate several configurations of the wall panel system 10 which are formed of common components such as the base panels 17, extension panels 24 and return walls 15 as well as other components. A more detailed discussion of a preferred embodiment of the wall panel system 10-1, however, is provided below with respect to FIGS. 8–23, and further features of the invention are illustrated in FIGS. 24–27.

Figure 2:
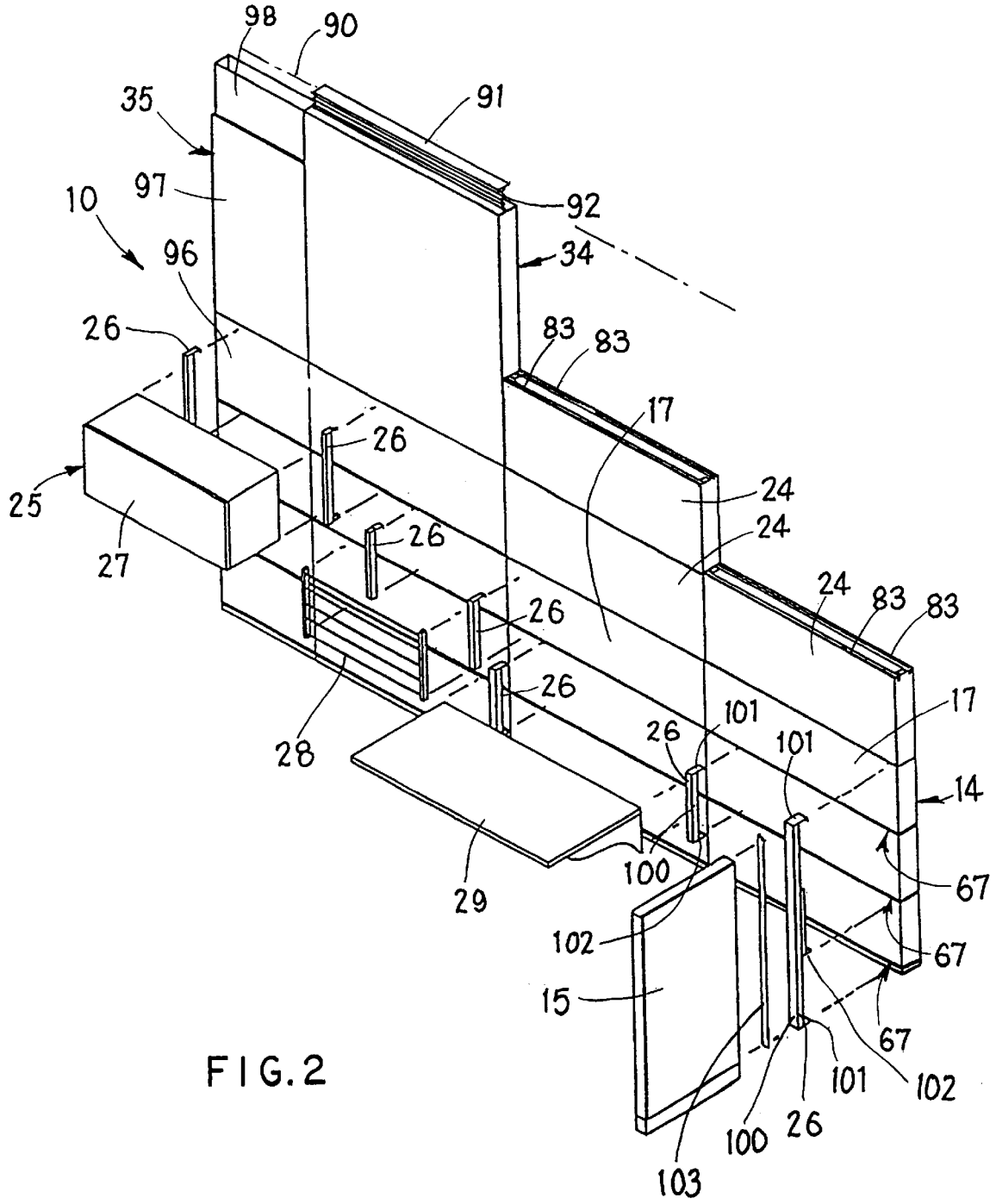
FIG. 2 is a front perspective view illustrating another alternative configuration of the space-dividing wall system.
Figures 3, 4:
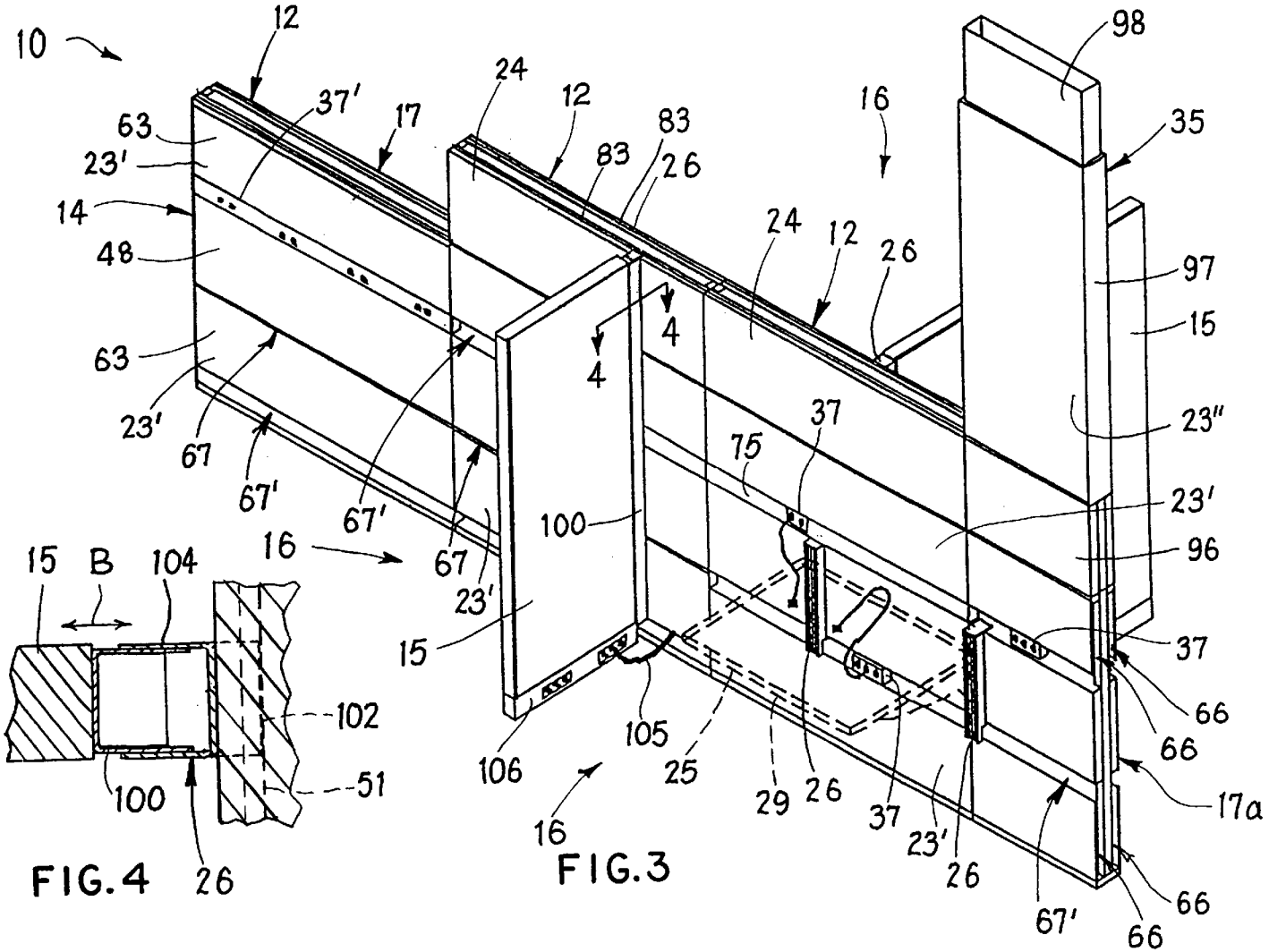
FIG. 3 is a front perspective view illustrating a further alternative configuration of the space-dividing wall system.
FIG. 4 is a partial top plan view in cross-section of a gap-filler assembly for a return wall as viewed in the direction of arrows 4—4 in FIG. 3.

Generally, with respect to the different components and configurations of FIGS. 1–7, the inventive wall panel system 10 typically includes the wall panel assemblies 12 as well as the return walls 15 which are selectively positioned and connected together to form various configurations of workstations 16 (FIGS. 1–3). To define the workstations 16, the wall panel assemblies 12 are serially connected one with the other to form at least a lower section of the linearly extending spine wall 14. To these base panels 17, the return walls 15 are connected so as to project transversely therefrom and hence define separate workstations 16. The spine wall 14, as described hereinafter, provides the primary load-bearing and cable-carrying capacity of the wall panel system 10 while the return walls 15 are branched off from the spine wall 14 and accommodate cabling received therefrom.

More particularly, each serially-connected wall panel assembly 12 (FIGS. 1–3) typically includes one base panel 17 supported in load-bearing relation on a floor, and one or more modular extension panels 24 positioned vertically one above the other in a vertical plane so as to define a modular wall panel height which is variable. The wall panel assemblies 12 are serially-connected together in a typically linear spine wall arrangement and have a plurality of return walls 15 connected on either or both of the opposite sides thereof. The return walls 15 are arranged in any of a variety of configurations to define the individual workstations 16 on one or both sides of the spine wall. The spine wall 14, however, not only serves the space dividing function served by the return walls 15, but also accommodates sufficient cabling (i.e., both communication and power) preferably for all of the workstations 16 while also supporting the significant loads of the various furniture components 25 connected thereto such as the return walls 15.

The inventive wall system 10 in particular has significant flexibility so that the spine wall 14 readily accommodates the connection of a wide variety of commercially-available return wall panels. Such return wall panels include those manufactured and sold by the assignee hereof, such as the PLACES wall panel system, as well as other commercially available wall panel systems as discussed hereinafter. The wall system 10 preferably is thus compatible with existing inventories of wall panels. Additionally, the return walls 15 also can be constructed substantially the same as the wall panel assemblies 12, and preferably, with a reduced overall width between the side faces thereof. Still further, additional wall panel assemblies 12 also can be connected to the spine wall 14 to define the return walls 15 instead of or in combination with commercially available wall panel arrangements.

Also, the wall panel assemblies 12 can be arranged in two-panel straight or angled configurations or still further, three- or four-panel configurations. Preferably, at least the three- or four-panel connections are provided by brackets. Also, a pivot joint can be provided for angular adjustment of one wall panel assembly 12 relative to another.

The furniture components 25 themselves are connectable to the base panels 17 or the extension panels 24 by connector brackets 26 of various constructions which, when connected to the wall panel arrangement, are horizontally slidable along the linear length of the spine wall 14 in the direction of reference arrow A (FIG. 1) as described hereinafter. Such connector brackets 26 are connectable to the spine wall at different modular heights as described herein, including mounting positions on the base panel 17 as well as a first tier of the extension panel 24.

Besides the return walls 15, a wide variety of other furniture components 25 (FIGS. 1 and 2), such as an overhead storage cabinet 27, paper management accessories 28, a work surface 29, and an exterior-mounted power or telecommunications receptacle unit 30 are readily mountable to the wall panel assemblies 12 anywhere along the length thereof. Such furniture components 25 are commercially available products sold by the assignee. Further, additional free-standing components (not illustrated) such as chairs, shelf units and filing cabinets can be positioned within each workstation 16.

While these components define a basic arrangement of the workstations 16, the inventive wall panel system 10 includes additional features to readily accommodate the various needs of the individual workstations 16. For example, in the illustrated arrangement of FIG. 1, one extension or add-on panel 24 is vertically positioned or "stacked" on each base panel 17, while the arrangement illustrated in FIG. 2 illustrates one or two extension panels 24 vertically positioned on the base panels 17. The extension panels 24 permit modular adjustment of the height of the spine wall 14. Still further, the spine wall 14 can also include a vertically enlarged filler or divider panel 34 which is adapted to extend from the top of the uppermost tier of extension panels 24 to approximately ceiling height to completely separate one office area from another.

The arrangement of FIG. 2 further illustrates a telescoping ceiling-infeed module 35 which is connectable to the wall panel assemblies 12 and provides a passage for routing of building cabling 36 (FIG. 5) into the wall panel system 10 from the ceiling.

Referring to FIG. 3, to accommodate additional electrified workstation equipment (not illustrated) such as telephones, computers, facsimile machines and the like, the wall panels 12 also selectively include electrical and/or telecommunications receptacles 37 at a base raceway height and/or at a beltline height disposed above the work surface 29 (FIG. 3). As described herein, the additional exterior receptacle unit 30 may also be provided and slidably mounted to the exterior of the wall panel system 10 as illustrated in FIG. 1 so as to be horizontally slidable along the length of each individual wall panel assembly 12.

More particularly with respect to the specific components of the system 10 (FIGS. 1–3), to provide the load-bearing capacity necessary to support the furniture components 25 including the return walls 15, each wall panel assembly 12 includes at least one of the base panels 17 which is a unit adapted to be supported on a floor. Each base panel 17 is formed with a structurally rigid and strong rectangular frame 38 (FIGS. 5 and 6A) having the box-like crossbeam 18 which extends horizontally and is connected at its opposite ends to the laterally spaced vertical uprights 19. Additionally, upper and lower cross rails 42 and 43 respectively are connected to the respective upper and lower free ends 40 and 39 of the uprights 19 in vertically spaced relation to the box-beam 18. This rigidity and strength is particularly important for supporting the return walls 15 which, when loaded with their own respective furniture components (not illustrated) and connected to the spine wall 14, transfer a significant torsional load to the spine wall 14.

Above and below the box-beam 18, the respective upper and lower raceways 21 and 22 are formed in the open interior or cavities of the base panel 17 at approximately beltline or base height respectively, which raceways 21 and 22 are closable on opposite sides by the removable covers or tiles 23. These raceways 21 and 22 are adapted to receive cabling as described below.

The uprights 19 are formed as hollow tubular members which, in a preferred embodiment, extend approximately 48 inches above the floor. The lower end 39 thereof is positioned for support on the floor by conventional panel glides (not illustrated) threadedly engaged to the frame 38. The upper end 40 of each upright 19 preferably opens upwardly for connection to the extension panels 24 as described hereinafter. The uprights 19 generally are laterally spaced apart to define the opposite ends (or edges) of each base panel 17.

To connect the box-beam 18 and uprights 19 together, the opposite ends of the box-beam 18 are provided with vertical channels or notches 41 which open laterally so as to receive the tubular upright 19 therein in close fitting engagement. The uprights 19 and box-beam 18 are fixedly connected together in a structurally rigid and strong connection such as by adhesives, fasteners or welding, depending upon the particular materials being used in the box-beam 18. By providing the channels 41, the connection is effected over a greater length and on three sides of the upright 19. The exposed end face of the upright 19, however, is substantially flush with the end of the box-beam 18.

The box-beam 18 is preferably vertically enlarged so as to have a vertical height defined by upper and lower beam walls 46 and 47, which height is a substantial portion of the vertical height of the uprights 19 defined between the opposite upper and lower ends 40 and 39 thereof. The box-beam 18 is thus connected to the uprights 19 along a substantial vertical length thereof, preferably approximately one-third the length of the uprights 19, so as to provide a structurally rigid connection therebetween.

To permit connection of the furniture components 25 to the base panels 17, the box-beam 18 has a width as defined between opposite side faces 48, which side faces 48 extend in vertical planes between the upper and lower beam walls 46 and 47. This width of the box-beam 18 is greater than the width of the uprights 19, which latter width is defined between the opposite side surfaces 49 thereof. Thus, each side face 48 of the box-beam 18 is spaced outwardly from the corresponding side surfaces 49 of the uprights 19 so as to define a stepped region disposed outwardly therefrom.

The side faces 48 of the box-beam 18 preferably define exposed finished surfaces which, for example, may be painted metal, vinyl covering or other suitable finishes. It should also be understood, however, that cover tiles similar to the cover tile 23 discussed herein, may be mounted to the side faces 48 and thereby define the exposed finished surfaces of the box-beam 18.

Typically the box-beam 18 is also formed with a spaced-apart pair of parallel channels 51 on each of the upper and lower beam walls 46 and 47. The channels 51 extend horizontally between the opposite ends of the base panel 17, and are disposed outwardly of the side surfaces 49 on the opposite sides of the uprights 19 in a non-interfering relation therewith. Each channel 51 not only opens vertically either upwardly or downwardly from the respective upper and lower beam walls 46 and 47, but also has opposite open ends 52 which open laterally. Thus, the channels 51 of the illustrated base panel 17 therefore align with corresponding channels 51 on a serially-adjacent base panel 17 so as to define parallel pairs of continuous, uninterrupted tracks 53 (FIG. 5) which extend horizontally between serially-adjacent wall panels 17 preferably along the entire linear length of the spine wall 14. Such channels 51, and accordingly the tracks 53, are adapted to receive therein hook-like ends of the connector brackets 26. Such connector brackets 26 are readily slidable along the continuous track 53 on and between serially adjacent wall panels 17 so as to provide continuous off-modular positioning of any of the furniture components 25 such as the outside-mounted receptacle unit 30 or the return walls 15 so as to permit ready reconfiguration of the workstations 16. Specific constructions of the connector brackets 26 will be described herein with respect to FIGS. 18–23.

The box-beam 18 also includes a cable passage 54 (FIG. 6A) extending vertically therethrough. In particular, the cable passage 54 is centrally disposed between the parallel channels 51. As a result, cabling can be routed vertically between the upper and lower raceways 21 and 22.

With respect to the upper and lower cross rails 42 and 43, these also are formed with a width which is greater than the width of the uprights 19 such that the edges of the cross rails 42 and 43 are spaced outwardly of the upright side surfaces 49. Similar to the box-beam 18, the cross rails 42 and 43 preferably include a spaced apart pair of parallel horizontal channels 55 which extend longitudinally between the opposite ends of the cross rails 42 and 43 and are each spaced outwardly of the uprights 19 in a non-interfering relation therewith. Each channel 55 preferably opens upwardly and has opposite open ends 56 which align with corresponding open ends 56 of the channels 55 of serially-adjacent base panels 17. These channels 55 of the upper and lower cross rails 42 and 43 define continuous, uninterrupted pairs of upper and lower tracks 57 and 58 respectively (FIG. 5) which extend longitudinally along the length of the spine wall 14.

The tracks 57, 53 and 58 are located on both sides of the uprights 19 and thereby define respective upper, intermediate and lower mounting locations for slidably connecting the connector brackets 26 to the spine wall 14. Due to the continuous, uninterrupted configuration of the tracks 53, 57 and 58, the connector brackets 26 are readily slidable not only along each individual base panel 17 but also along the entire length of the spine wall 14. The continuous off-modularity provided by the tracks 53, 57 and 58 permits ready repositioning of the connector brackets 26 and thereby permits repositioning of the furniture components 25 that are connected thereto without requiring that they be removed from the spine wall 14 to allow for repositioning. This flexibility afforded by the continuous off-modularity of the spine wall 14 permits ready reconfiguration of the workstations 16.

Figure 7A:
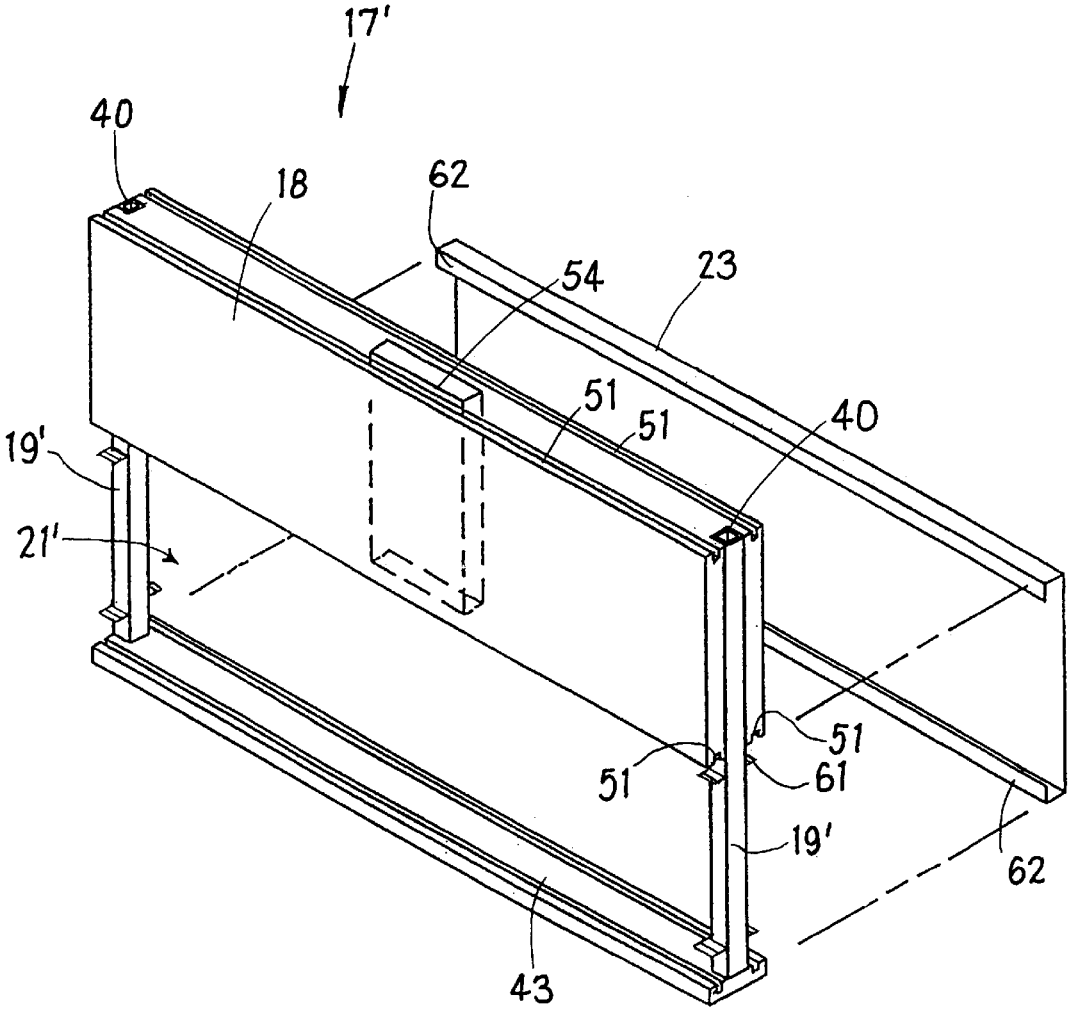
FIG. 7A is an exploded front perspective view of a second variation of the base panel of FIG. 6A.

Preferably, the upper and lower cross rails 42 and 43 are removably connected (as by threaded fasteners) to the upper and lower ends 40 and 39 of the uprights 19. Another embodiment of the base panel 17' is illustrated in FIG. 7A which only includes a single raceway 21'. This particular embodiment includes the same box-beam 18 which is connected to the upper ends of uprights 19' that have a shorter length than those described above. One cross rail 42 is connected to the distal free ends of the uprights 19'.

It should also be understood from the embodiment of FIG. 7A that the actual base panel height can be varied by varying the length of each upright such as uprights 19 or 19'. While such height preferably is set during manufacture, it is also possible to vary the length of the uprights on-site if necessary.

To enclose the raceways 21 and 22 of the base panels 17 (FIG. 6A), the cover panels 23 removably mount to the frame 38 by mounting means 61, for example, resilient connectors or spring clips which engage the cover panels 23. In particular, the cover panels 23 are herein formed with flanges 62 along the horizontal upper and lower edges thereof which abut against the uprights 19 such that the vertical panel face 63 is oriented substantially flush with the side faces 48 of the box-beam 18 as seen in FIGS. 1–3. Accordingly, the cover panel 23 is mounted with an interior surface 64 thereof spaced outwardly from the side surfaces 49 of the uprights 19 so as to define laterally opening passages 66 (FIGS. 3 and 6A) at the opposite ends thereof.

Referring generally to FIGS. 1–3, while the cover panel 23 vertically spans one of the raceways 21 and 22, at least a small gap 67 is formed between adjacent, vertically spaced horizontal edges of the cover panel 23 and the box-beam 18 or the lower cross rail 43. The gaps 67 extend horizontally along the length of the base panel 17 and permit the exit and entry of cabling therethrough between the raceways 21 and 22 and the exterior of the base panels 17.

To provide space for receiving the power or telecommunications receptacles 37, a reduced height cover panel 23' may also create a larger gap 67' (FIG. 3) so that receptacles 37 can be seated within the interior of the base panels 17 substantially flush with the side beam faces 48 and the panel faces 63 while being accessible from the exterior. One edge of the cover panel 23' typically is vertically offset so that the gap 67' is formed either below the cover panel 23' as seen on the left side of FIG. 3 or above the cover panel 23' as seen on the right side thereof.

Figure 5:
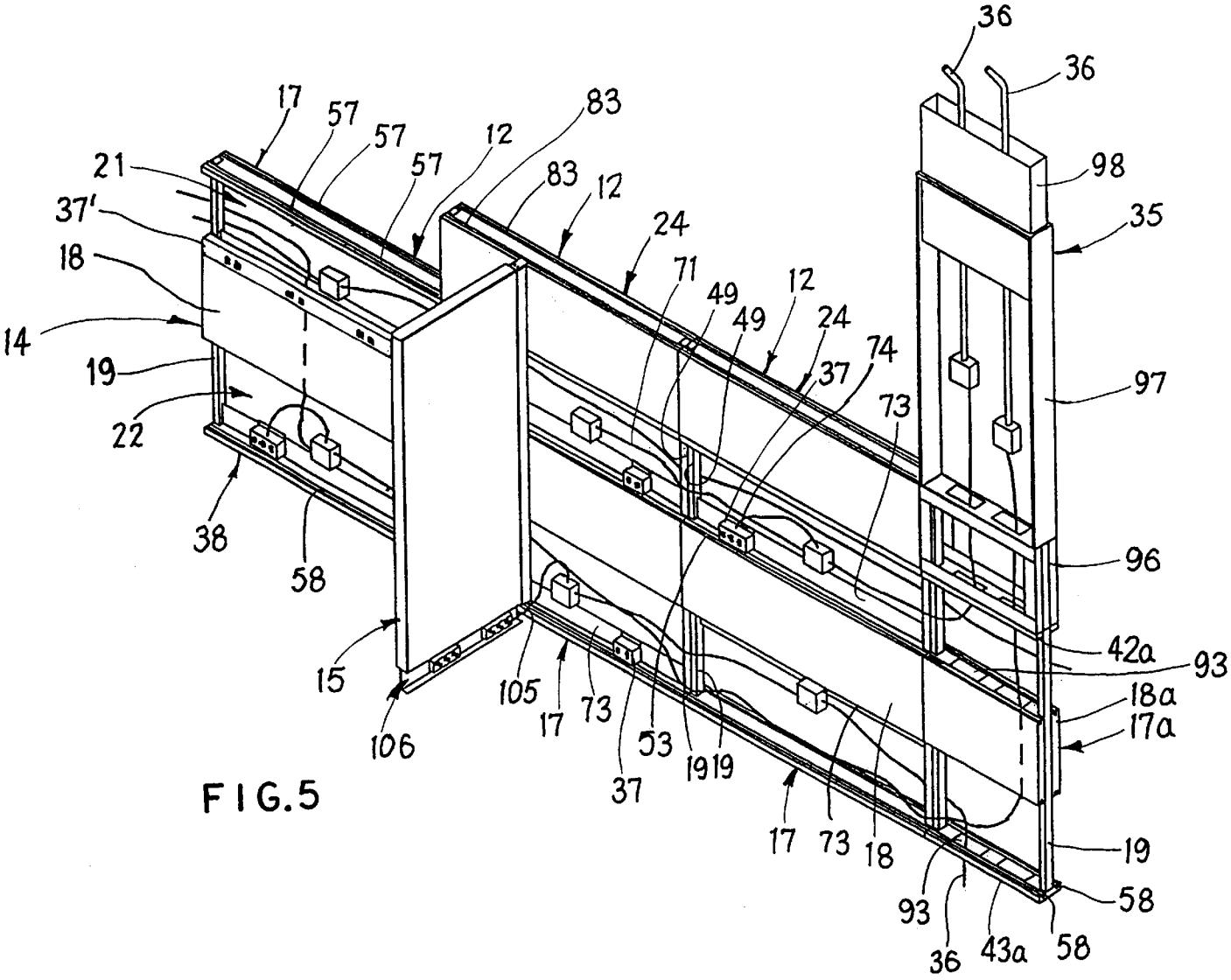
FIG. 5 is a front-perspective view of the space-dividing wall panel arrangement of FIG. 3 with cover panels removed.
Figure 6A:
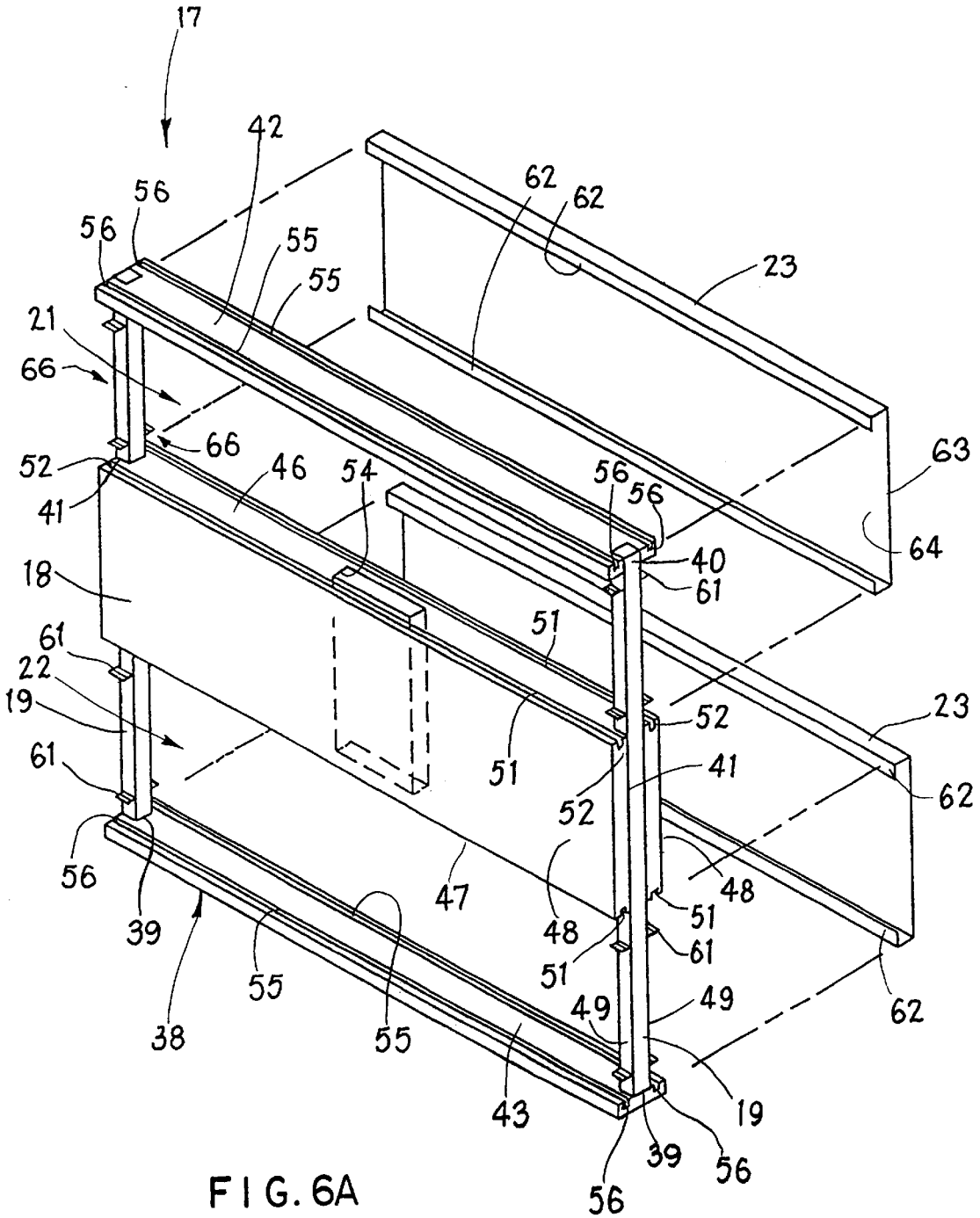
FIG. 6A is an exploded front perspective view of a base panel of the space-dividing wall panel system illustrated in FIGS. 1–5.
Figure 6B:
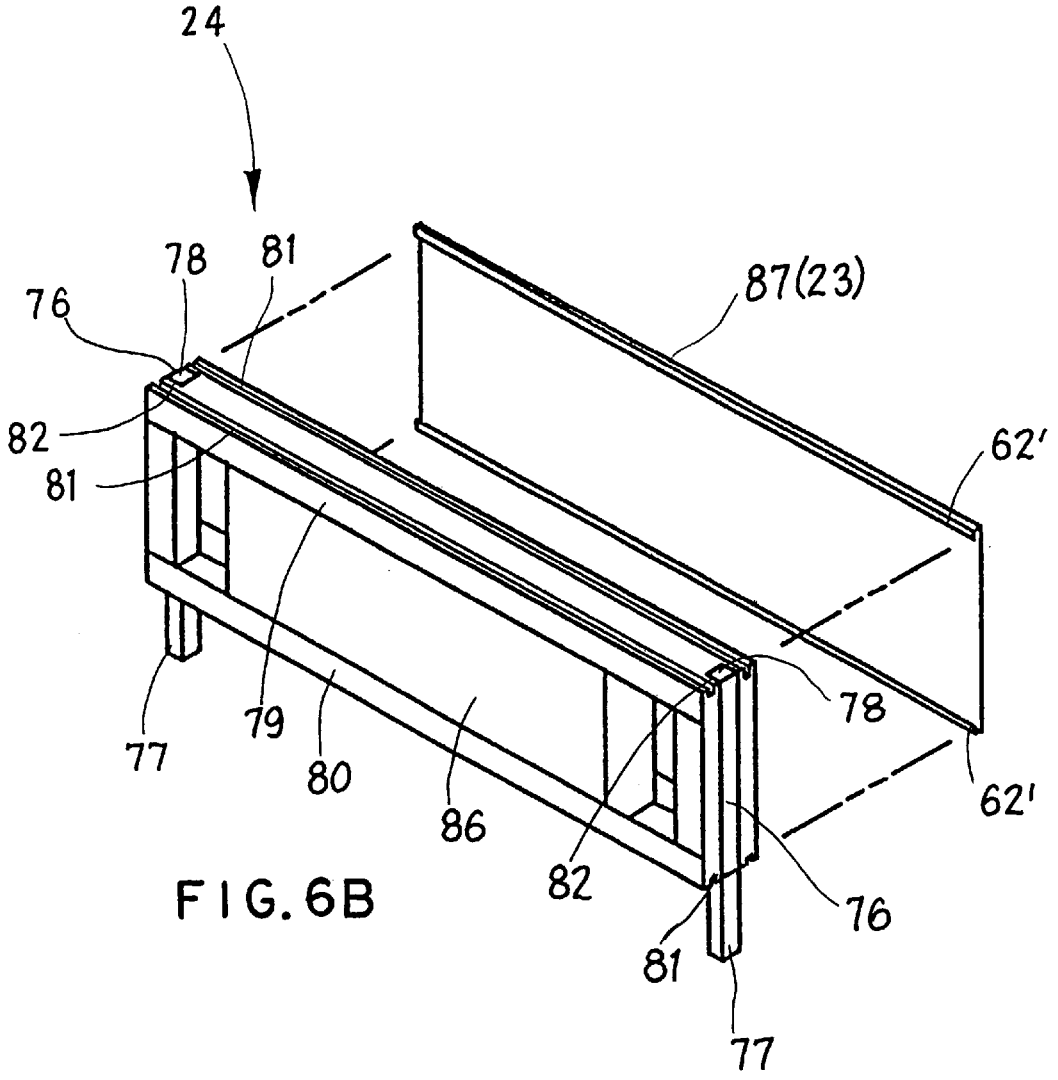
FIG. 6B is an exploded front perspective view of an extension or add-on panel of the space-dividing wall panel system illustrated in FIGS. 1–5.

More particularly, with respect to managing cabling within the wall panel system 10 and, in particular, within the upper and lower raceways 21 and 22 of the embodiments illustrated in FIGS. 1–7, each raceway 21 and 22 extends horizontally between the opposite ends of the base panel 17 (FIGS. 5 and 6A). Such raceways 21 and 22 preferably define the upper and lower thirds of the base panel 17 so as to accommodate a significant amount of cabling therethrough, which capacity preferably is significantly greater than the return walls 15 illustrated in FIGS. 1–3. Each horizontal raceway 21 and 22 opens laterally from the opposite ends of the base panel 17 due to the clearance or passages 66 between the side faces 48 of the beam and the side surfaces 49 of the uprights 19. Each passage 66 communicates with a serially adjacent base panel 17 so that continuous horizontal raceways extends along the entire length of the spine wall 14 both above and below the box-beam 18. As a result, individual cables 71 which are laid into the upper and lower raceways 21 and 22 thereby extend over the side surfaces 49 of the uprights 19 as generally shown in FIG. 5. This allows for easy laying in of the power and/or communication cabling 71 into the raceways 21 and 22, without extending the cabling horizontally through structural components. Such cabling 71 can also pass vertically between the upper raceway 21 and the lower raceway 22 through the vertical passage 54 (FIG. 6A) formed in the box-beam 18.

The receptacles 37 themselves are either fixedly connected to the frame components or, as illustrated in FIG. 5, slidably connected to a vertical mounting plate or septum 73 which extends laterally across a raceway 21 or 22. As seen in FIGS. 3 and 5, the plate or septum 73 can be formed on both the top and bottom of the box-beam 18 as well as the cross rail 43 to define at least three mounting locations for the receptacle 37. The septum 73 can be formed either integral with the box-beam 18 or as a separate mountable component which is mounted to the frame of the base panel 17.

More particularly, the receptacle 37 includes a hook-like projection 74 which slides over the free edge of the mounting plate 73. The receptacle 37 is connected to the cabling 71 and also is slidable along the length of the mounting plate 73 so as to permit relocation of the receptacle 37 along the length of the base panel 17. Each receptacle 37 houses conventional outlets such as three-prong power outlets or telecommunication jacks which are accessible from the exterior of the base panel 17. The receptacles 37 preferably are "tethered" receptacles which include a cable extending therefrom that connects to electrical wiring within the raceways 21 or 22. To close the gap, an elongate cover plate 75 preferably is provided which has prepunched openings or knockouts to allow access to receptacles 37 if necessary. If a separate cover plate 75 is not desired, the cover tile 23 can have a vertical dimension which overlies the upper and lower raceways 21 and 22 and can be provided with receptacle ports or openings adapted to receive the receptacle when the cover panel 23 is mounted to the base panel 17.

As an alternative to the receptacle 37, an elongate receptacle console or strip 37' may be mounted in the gap 67' (FIGS. 3 and 5). The console 37' is a single elongate metal or plastic box-like unit and has a hook-like projection. The console 37' is removably connected to the base panel 17 while essentially filling the gap 67' formed by the cover panel 23'. The receptacle console 37' preferably includes a plurality of outlets or telecommunication jacks along the length thereof which are accessible from the exterior.

Still further, the exterior receptacle unit 30 may be provided, which unit includes a hook-like projection for slidably suspending the receptacle unit 30 to the mounting plate 73 or to one of the tracks 51, 55 or 83. The exterior receptacle 30 extends downwardly on the exterior of the base panel 17, and may be relocatable along the length of the spine wall 14.

To vary the height of the wall panel assemblies 12, one or more tiers of the extension panels 24 are vertically stackable on top of the base panels 17 (FIGS. 1–3). Each extension panel 24 (FIG. 6B) includes laterally spaced vertical uprights 76 having downwardly projecting bayonet connectors or stakes 77 at the lower ends thereof while upper ends 78 are open. The bayonet connectors 77 are adapted to engage either the open upper ends 40 of the base panels 17 for direct connection thereto or to the open upper ends 78 of a lower tier of the extension panels 24 already positioned on the base panel 17.

The extension panel 24 also includes upper and lower horizontal cross rails 79 and 80 similar to the cross rails 42 and 43. The cross rails 79 and 80 have a width greater than the uprights 76 and include a pair of spaced apart parallel channels 81 which are disposed outwardly of the side surfaces 82 of the uprights 76 in non-interfering relation therewith. The channels 81 are substantially identical to the channels 55 and form additional continuous tracks 83 (FIG. 3) which extend the length of the spine wall 14.

To provide additional strength to the extension panels 24, an additional solid core 86, for example, of foam is formed in the open interior of the panel 24 and may be enclosed with rigid planar skins 87 or with cover panels 23 mounted thereto by mounting means such as fasteners, adhesives or the like. The skins 87 may be formed of metal, hardboard or other suitable material.

Figure 7B:
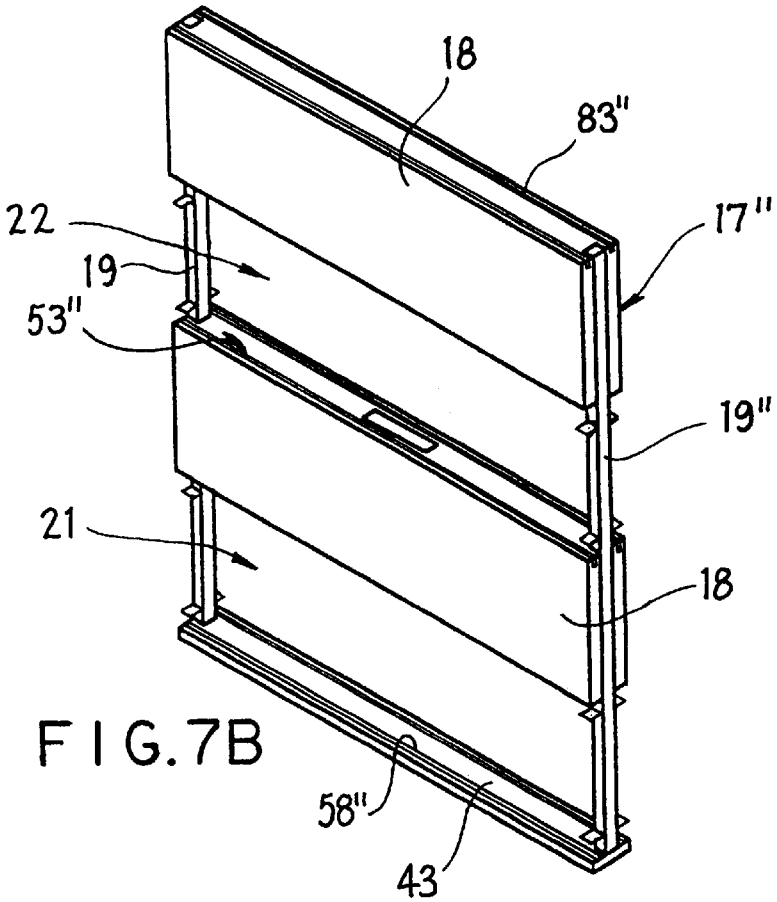
FIG. 7B is a front perspective view of a third variation of the base panel.
Figure 7C:
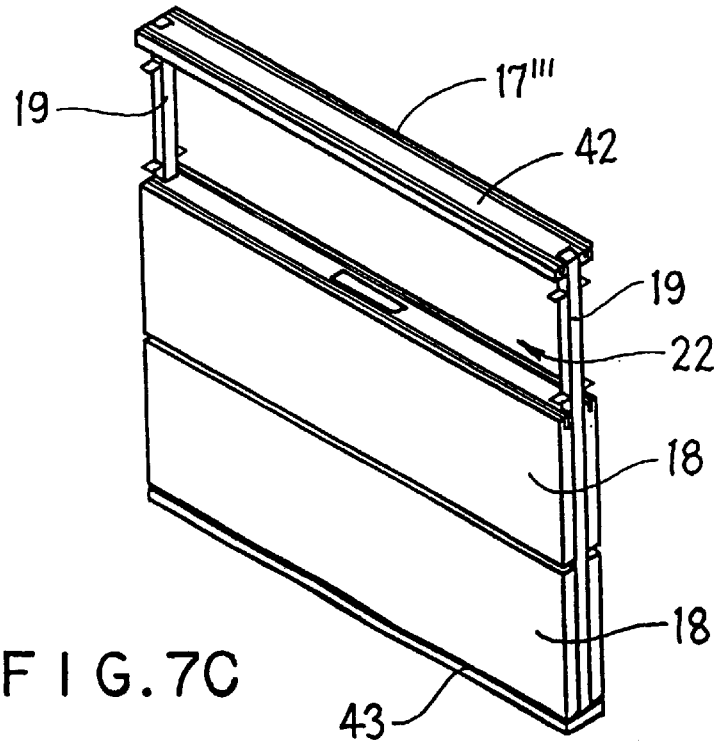
FIG. 7C is a front perspective view of a fourth variation of the base panel.

It is also possible to form the base panel 17 and extension panel 24 as a single wall panel to define the wall panel assembly 12 as seen in FIG. 7B. In particular, instead of two separate panels 17 and 24, a single wall panel can be formed having uprights which extend to the height of the extension panels 24, whereby one box-beam is positioned at the same height as the box-beam 18 while a second box-beam is connected to the uprights 19" at a height corresponding to the height of the extension panel 24 described above. Thus, a single wall panel is formed having two spaced apart uprights 19" with two vertically spaced box-beams 18. Preferably, at least the box-beam 18 and raceways 21 and 22 have modular vertical heights preferably of 16 inches which define equal thirds of the overall height of the base panel 17. Thus, the tracks 53, 57 and 58 are positioned at equally spaced modular heights.

The base panel 17 can alternatively be formed of other combinations of box-beams 18 and raceways 21 (22) which permit the overall modular height of the base panel 17 to be varied or the particular number and locations of box-beams and raceways. For example, a base panel 17''' (FIG. 7C) can be formed with two vertically adjacent box-beams 18 and a single raceway 22 formed between the cross rail 42 and the box-beams 18. Preferably, the channels on the box-beams 18 are accessible from the exterior thereof for connection of the connector brackets 26 thereto. To vary or select the vertical position of the raceway 22, the base panel 17''' is flipped over or rotated in a vertical plane about the horizontal longitudinal axis thereof. The cross rail 42 is also removed and rotated about its longitudinal axis so that the raceway 22 is now disposed below the box-beams 18. Then the cross rail 42 is reattached to the free ends of the uprights 19 so that the box-beams 18 are now disposed above the floor. Thus, one base panel 17''' is usable in two different orientations while using the same component parts. The panel 17''' therefore is vertically reversible to vary the elevation of the raceway and tracks thereof. Preferably, in all of these variations, the beams and raceways have equal modular dimensions so as to define different modular heights for the wall panel assemblies 12.

When it is desirable to enclose the vertical space or gap between the ceiling and the top of panel assembly 12, for example for privacy, the divider or filler wall 34 (FIG. 2) is mountable to one of the panels 17 or 24 by a similar bayonet connection as described above. Since the vertical height of the gap may vary, the divider wall 34 also includes along the uppermost horizontal edge thereof a gap-filler assembly 89. The gap-filler assembly 89 includes a top plate 91 at an upper end thereof positioned for contact with a ceiling (as indicated by line 90) and an expandable member 92 such as a foldable bellows which connects between the divider wall 34 and the top plate 90 and increases the vertical height of the divider wall 34 as required. A similar gap-filler assembly 89 also may be mounted to vertical side edges of the divider wall 34. The divider wall 34 is formed from any suitable rigid material such as foam or, alternatively, may be formed of a transparent or translucent material such as plastic.

To supply the cabling 36 to the spine wall 14, a bottom feed panel 17*a* (FIGS. 3 and 5) can be serially connected to the spine wall 14 either at or intermediate the opposite ends thereof. The bottom feed panel 17*a* is formed with a box-beam 18*a* having a length shorter than that in the base panel 17, and upper and lower cross rails 42*a* and 43*a* having vertical passages 93 extending therethrough. Thus, cabling 36 can be fed into the upper and lower raceways 21 and 22 from the floor.

The bottom feed panel 17*a* also is usable with the ceiling infeed module 35 that mounts thereon. The ceiling infeed module 35 supplies the cabling 36 to the spine wall 14 through the passages 93 of the upper cross rail 42*a*. The infeed module 35 includes a hollow rectangular add-on panel section 96 which is formed with a rectangular frame like the extension panel 24 but without the core 86. The infeed module 35 mounts to the base panel 17 through a bayonet connection as described above. Extending upwardly from the panel section 96 is a vertical telescoping section 97 which includes a slidable tubular element 98 which is vertically adjustable and connects to the ceiling. Preferably, openable covers 23" are either removably attached or hingedly connected thereto to define a readily accessible cabling closet.

It is also possible to form the base panel 17 and the extension panels 24 so as to include passages through the horizontal rails 42, 43, 79 and 80 to permit cabling to be routed between the base and extension panels 17 and 24. The core 86 preferably is omitted to permit additional electrical components and cabling to be mounted in the extension panel 24.

The spine wall 14 is constructed and the appropriate electrical infeed connected thereto, and the workstations 16 are formed by connection of the return walls 15 to the spine wall 14. As described above, the return walls 15 can be any commercially available wall panel system. Alternatively, the return walls 15 could be reduced-width embodiments of the wall panel assemblies 12. These reduced-width embodiments of the wall panel assemblies 12, or the wall panel assemblies 12 for that matter, can be connected to the spine wall 14 by appropriate connector brackets 26.

Generally, the connector bracket 26 (FIG. 2) for the return walls 15 serves as a wall panel interface and includes a vertically elongate rail 100 having hook-like projections 101 at the opposite ends thereof which define connector means. The projections 101 preferably engage within the upper and lower tracks 57 and 58 of the base panel 17. As shown in FIG. 3, the rail 100 also may extend to the height of the tracks 83 and with which the upper projection plate 101 is engaged. This connector bracket 26 also includes a removable anti-dislodgement bracket 102 having an upwardly directed projection for engagement with the downward opening tracks 53 on the lower beam wall 47. The connector bracket 26 further includes a wall mounting assembly 103 which fastens to the rail 100 and is adapted to connect the return wall 15 to the rail 100. Preferably, the wall mounting assembly 103 differs for each type of commercially available wall panel arrangement so that the spine wall 14 is not limited to use with a single type of return wall 15. Rather, the wall mounting assembly 103 serves as an adaptor so that almost any type of wall panel is connectable thereto. As discussed above, this wall mounting assembly 103 also can be formed so as to connect additional wall panel assemblies 12 to the spine wall 14. Still further, the assembly 103 also can be omitted and the return walls 15 connected directly to the rail 100 by suitable fastening means.

While the return walls 15 are described as defining individual workstations 16, the skilled artisan will also appreciate that return walls 15 may be connected to the spine wall 14 solely for providing a support member for the spine wall 14. In other words, the return wall 15 when projecting outwardly from the spine wall 14 serves as a support leg for the spine wall 14.

The connector bracket 26 for the return wall 15 further includes a U-shaped gap-filling channel 104 (FIG. 4) which is slidably received over the rail 100 between the rail 100 and the base panel 17. The channel 104 is slidable toward and away from the base panel 17 in the direction of reference arrow B to butt against the wall panel assembly 12 and therefore fill any space therebetween. The channel 104 also is movable away from the base panel 17 to permit removal of the cover panel 23 without removal of the return walls 15.

Once the return wall 15 is connected in place, electrical and telecommunications cabling 105 (FIGS. 3 and 5) can be routed to the base raceway 106 of the return wall 15 from the spine wall 14 where necessary. Such cabling 105 can be routed either externally to the return wall 15 (FIG. 3) or directly through the end face of the return wall 15 (FIG. 5), which cabling 105 exits the base panel 17 through the gap 67 formed between the cover tile 23 and the lower cross rail 43. Alternatively, cabling (not shown) can exit or enter the base panel 17 through the further gaps 67 formed adjacent the box-beam 18 or the upper cross rail 42.

The connector brackets 26 for the other furniture components 25 (FIG. 2) such as the storage cabinet 27, ladder-like rack 28 or work surface 29 are of similar construction and include a vertical rail 100 having at least one downwardly extending projection 101 for engagement in a selected one of the channels 53, 58 or 81. The rail 100 also may include an anti-dislodgement member 102. Once the connector brackets 26 are connected to the wall panel assemblies 12, the furniture components 25 themselves are connected thereto.

Since all of the connector brackets 26 for both the return walls 15 and the other furniture components 25 are slidable, the workstations 16 can be readily reconfigured by sliding the furniture components 25 including the return walls 15 along the respective tracks 53, 57, 58 and 83 on the base panels 17 and the extension panels 24. Still further, while the connector brackets 26 and furniture components 25 are specifically described above as separate components, the skilled artisan will appreciate that the furniture components and connector brackets 26 can, in some instances, be non-removably connected together as a single unit.

While the above description of FIGS. 1–7 generally describes the divider wall system 10, a more detailed description of specific embodiments is provided hereinafter with respect to FIGS. 8–27. More particularly, the aforesaid features of the invention are incorporated into the metal embodiment illustrated in FIGS. 8–23.

In more detail with respect to FIGS. 8–23, the wall panel system 10-1 illustrated therein is substantially the same as that described above with respect to FIGS. 1–7 and is constructed pursuant to the above disclosure. It will be understood that the following components can be arranged into any of numerous configurations to divide office space as described above.

Figure 8:
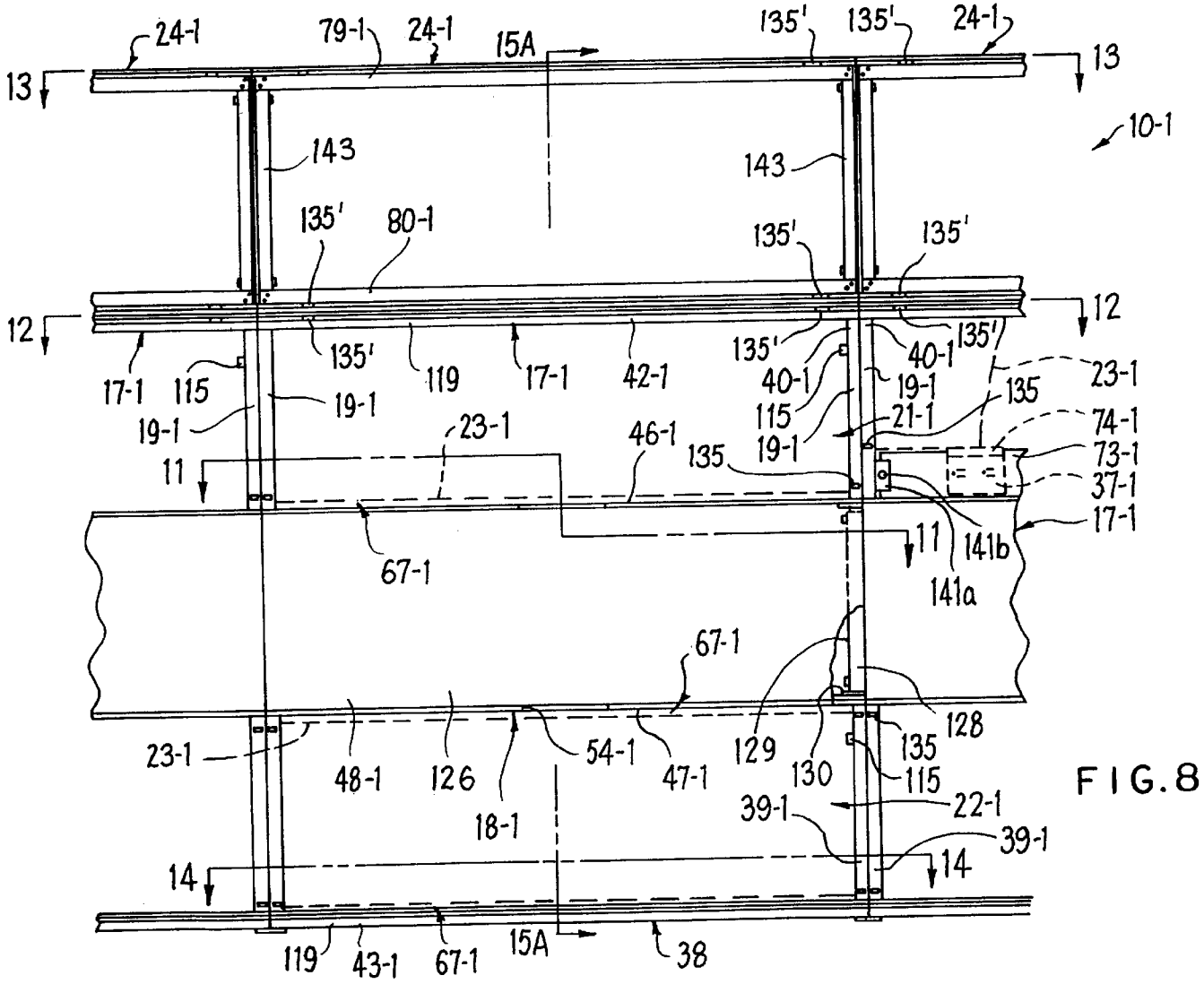
FIG. 8 is a partial front elevational view of a second embodiment of the space-dividing wall panel system with cover tiles removed.

With respect to the preferred base panel 17-1, FIG. 8 illustrates three such panels 17-1 serially connected in a linear relation. Additionally, corresponding extension panels 24-1 are mounted vertically on top of the base panels 17-1 as described herein.

With respect to the base panel 17-1, each of the vertical uprights 19-1 is constructed of square metal tubing which has a vertical length extending, in a preferred embodiment, approximately 48 inches above the floor to define the vertical height of the base panel 17-1. While not specifically illustrated, the base panel 17-1 can alternatively be formed with a height of approximately beltline height as previously disclosed herein with respect to FIG. 7.

Figures 11, 12, 13:
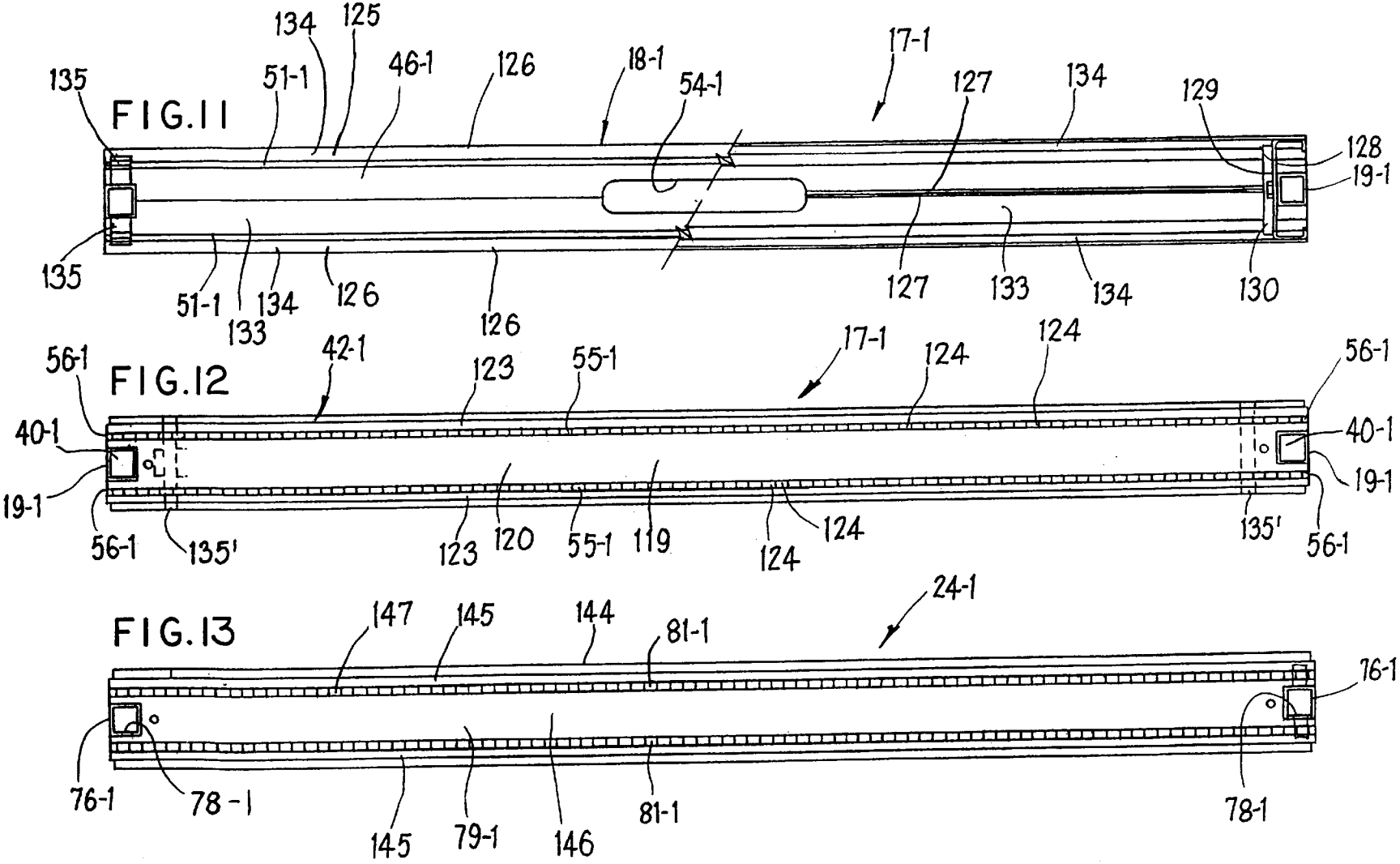
FIG. 11 is a top plan view in cross-section of a box-like beam of the base panel as viewed in the direction of arrows 11—11 in FIG. 8.
FIG. 12 is a top plan view of the base panel as viewed in the direction of arrows 12—12 in FIG. 8.
FIG. 13 is a top plan view of an extension panel as viewed in the direction of arrows 13—13 in FIG. 8.
Figure 14:
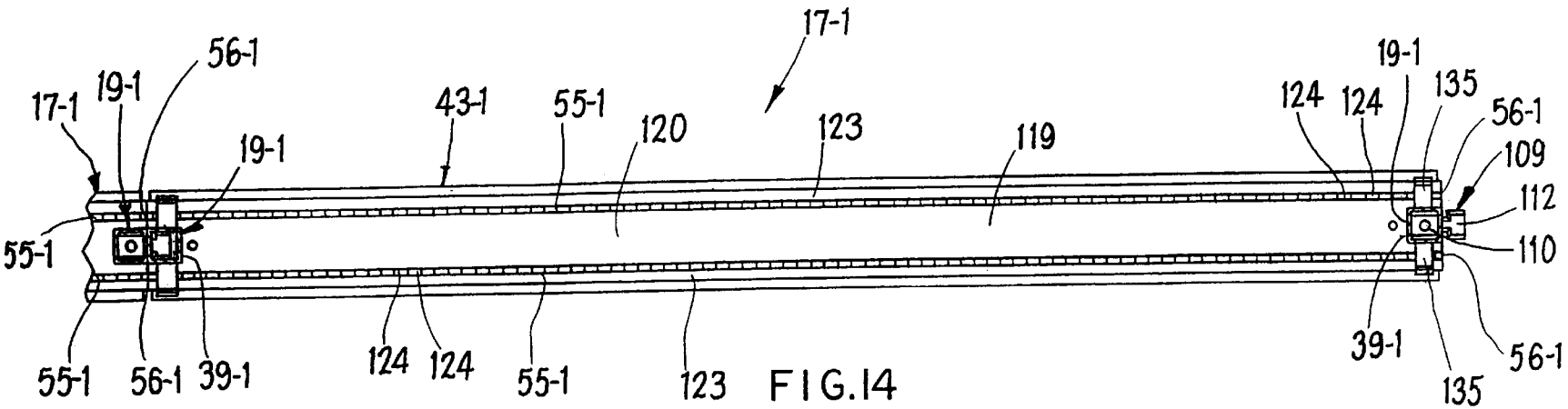
FIG. 14 is a top plan view in cross-section of a lower cross rail of the base panel as viewed in the direction of arrows 14—14 in FIG. 8.

The tubing of the uprights 19-1 is hollow with the upper end 40-1 thereof opening upwardly as seen in FIG. 12. To effect connection of two serially-adjacent base panels 17-1 together, however, the lower end 39-1 of the rightward upright 19-1 as illustrated in FIG. 14 includes a generally hourglass-shaped connector block 109 which is narrower in a middle region thereof. The connector block 109 has a first square insert portion 110 which inserts and is fixedly connected into the open lower end 39-1 of the upright 19-1. The end face of the upright 19-1 includes a notch (not illustrated) through which a narrowed section of the connector block 109 extends so as to project laterally away from the end face and terminate in a rectangular connector portion 112.

This connector portion 112 is adapted to engage a serially-adjacent upright 19-1 of a serially-adjacent base panel 17-1. In particular, the leftward upright 19-1 of each base panel 17-1 includes a notch 113 (FIG. 10) at the open lower end 39-1 thereof which is adapted to seat over the narrowed section of the connector block 109 and receive the connector portion 112 of the mutually adjacent connector block 109 as illustrated on the leftward portion of FIG. 14. In accord therewith, the lowermost ends 39-1 of each pair of serially-adjacent base panels 17-1 are engaged one with the other by seating the connector block 109 of one base panel 17-1 into the lower end 39-1 of another base panel 17-1 through the corresponding notch 113 so that the lower ends 39-1 are positively engaged one with the other.

To prevent disconnection of two serially adjacent base panels 17-1, each upright 19-1 also is formed with one or more vertical spaced apertures 114 (FIG. 10) formed therein, whereby the rightward upright 19-1 permits the passage of fasteners 115 (FIG. 8) therethrough, which fasteners 115 are threadingly engaged with the corresponding aligned apertures 114 of a mutually adjacent upright 19-1. By these connector means which include the connector block 109 and the fastener 115, each serially adjacent pair of base panels 17-1 are securely joined together. While fasteners 115 are used, it may also be desirable to replace the fasteners 115 with a latch-type connector (not illustrated) proximate the top of the base panel 17-1, which latch-type connector is secured to one base panel 17-1 and is adapted to removably engage a serially-adjacent base panel 17-1.

The lowermost ends 39-1 of the uprights 19-1 also include an L-shaped bracket 116 (FIG. 15) which is preferably welded thereto and projects laterally inwardly for supporting the lower cross rail 43-1 thereon by suitable fastening methods such as welding or fasteners. Similar L-shaped brackets 116 also are fixed to the uprights 19-1 at the upper ends thereof for fixedly connecting the upper cross rail 42-1 thereon.

Each of the upper and lower cross rails 42-1 and 43-1 are formed substantially identical as illustrated in FIGS. 12, 14 and 15. In particular, each of the cross rails 42-1 and 43-1 includes a horizontally elongate bottom plate 118 and a similar horizontally elongate rail housing 119 which overlies and is connected together with the bottom plate 118, preferably by welding. Each cross rail 42-1 and 43-1 therefore is formed as a hollow tubular member which extends laterally between the uprights 19-1. Although in this preferred embodiment the cross rails 42-1 and 43-1 are fixedly secured to the angle brackets 116 preferably by welding or the like, removable fasteners also can be used as described herein with respect to FIG. 7, so as to permit ready removal of the cross rails 42-1 and 43-1 for rotation and reorientation of the base panel 17-1.

The rail housing 119 preferably is formed and shaped from a metal sheet so as to have the cross-sectional configuration illustrated in FIG. 15 and, in particular, include a pair of channels 55-1 which are spaced outwardly from the respective side surfaces 49-1 of the upright 19-1. These channels 55-1 are separated one from the other by a central section or land 120 which extends sidewardly between the channels 55-1 and longitudinally along the length of the respective cross rail 42-1 or 43-1 as also shown in FIGS. 12 and 14. The central section 120 projects upwardly above the channels 55-1 so as to define a back wall of each channel 55-1 while an additional stepped portion 123 spaced outwardly from the central portion 120 defines a front wall of each channel 55-1. These front walls have a lower vertical height than the central portion 120 as described herein.

Referring to FIGS. 12 and 14, each channel 55-1 on the upper and lower ends of the uprights 19-1 preferably are formed with a plurality of spaced rectangular apertures or perforations 124 along the entire length of each channel 55-1 between the open channel ends 56-1. These apertures 124 open vertically through the bottom of the channel 55-1 as well as horizontally through the back wall thereof so as to define L-shaped openings (FIG. 15B). The apertures 124 are provided for fixed engagement with at least the connector bracket 26-1 (FIGS. 21 and 22) as described hereinafter. Additionally, the open ends 56-1 of each channel 55-1 are positioned for alignment with the corresponding open ends 56-1 of a serially adjacent base panel 17-1 as seen in FIG. 14 to define the upper and lower tracks 57-1 or 58-1.

To connect the cross rails 42-1 and 43-1 to the uprights 19-1, the opposite ends of the cross rails 42-1 and 43-1 are notched to receive the respective upper and lower ends of the uprights 19-1 therein. With respect to the upper cross rail 42-1 (FIG. 12), the upper ends 40-1 open upwardly from the upper cross rail 42 to effect the bayonet connection of the extension panel 24-1 thereto.

To effect connection of cover panels 23-1 to the upper cross rail 42-1, at least the upper cross rail 42-1 (FIG. 15B)

includes openings 119*a* formed in the side walls 119*b* of the upper rail housing 119. The apertures 119*a* preferably extend vertically and horizontally in the region disposed outwardly of the stepped portions 133. At least the upper cross rail 42-1 includes mounting means 61-1 and in particular, an elongate spring clip 135' which extends sidewardly through the openings 119*a* on the opposite sides of the cross rail and projects outwardly therefrom so as to engage the flange 62-1 of a cover panel 23-1. Thus, the cover panel 23-1 can be snapped to the cross rail 42-1.

With respect to the box-beam 18-1, a two-piece construction is used to form the box-beam 18-1 as can be seen in FIGS. 8 and 15. More particularly, the box-beam 18-1 is formed of two vertically enlarged beam halves 125 and 126 which are formed as substantially mirror images, and are formed from sheet metal into the desired configuration. Each beam half 125 and 126 has a sidewardly opening U-shape and includes vertically depending connector flanges 127 along the upper and lower edges thereof which are welded together so as to connect the beam halves 125 and 126 together and form a box-like configuration defined by the upper and lower beam walls 46-1 and 47-1 as well as the vertically enlarged side faces 48-1. Preferably the side faces 48-1 are finished by painting, however, additional surface finishes can be applied thereto.

When the beam halves 125 and 126 are connected together, the opposite ends thereof open laterally so as to receive end mounting plates 128 therein and have notches 141 in the upper and lower walls 46-1 and 47-1 so as to receive the uprights 19-1 therein. To connect the box-beam 18-1 to the uprights 19-1, each end mounting plate 128 has a generally U-shaped cross-sectional shape as seen in FIG. 11 which is adapted to seat within the open interior space between the side beam faces 48-1 and is secured thereto, preferably by welding. More particularly, the mounting plate 128 is positioned so that a vertical central section 129 closes the open end of the box-beam 18-1 while abutting against an interior face of the upright 19-1 so as to permit fastening of the box-beam 18-1 thereto, such as by fasteners or welding. Further, the central section 129 includes inwardly extending flanges 130 at the top and bottom thereof which are adapted to abut against the interior surface of the channels 51-1. With these mounting plates 128, the opposite ends of the box-beam 18-1 are generally enclosed and fixedly secured to the uprights 19-1.

Similar to the cross rails 42-1 and 43-1 discussed above, the upper beam wall 46-1 is formed with a pair of spaced apart parallel channels 51-1 extending longitudinally along the length of the beam 18-1. A rear wall of each channel 51-1 is formed by an upwardly extending central portion 133 while a stepped portion 134 which defines a front wall of the channel 51-1 is spaced outwardly therefrom. The lower beam wall 47-1 is formed substantially the same as the upper beam wall 46-1 so as to include additional downwardly and horizontally opening channels 51-1 which are defined by the central portion 133 and respective stepped front walls 134.

While the channels 51-1 are illustrated with solid longitudinally extending walls, the channels 51-1 preferably are formed with the longitudinally spaced apertures or perforations 124. Thus, additional positive engagement with the connector bracket 26-5 can be permitted.

The beam halves 125 and 126 further are notched in the region of the central portion 133 thereof so as to define openings through the upper and lower beam walls 46-1 and 47-1 which thereby define the vertical cable passage 54-1. As described above, the vertical passage 54-1 allows for the passage of cabling therethrough between the upper and lower raceways 21-1 and 22-1. Preferably, in this embodiment, the box-beam 18-1 has a hollow interior cavity. While a two-piece construction of the beam halves 125 and 126 is disclosed, the box-beam 18-1 also could be formed as an extruded one-piece hollow construction.

To effect connection of cover panels 23-1 over the upper and lower raceways 21-1 and 22-1, a plurality of resilient mounting clips 135 are connected to the frame 38-1. In particular, the mounting clips 135 project outwardly from the side surfaces 49-1 of the uprights 19-1 although the two uppermost mounting clips 135' are connected to the upper cross rail 42-1 (FIG. 15B). These mounting clips 135 and 135' are formed of resilient spring steel and have a V-shaped section which is adapted to secure the cover panels 23-1 thereon. The flanges 62-1 of the cover panel 23-1 thereby effects flexing of the spring clip 135 to allow the cover panel 23-1 to be snapped into engagement. The panel face 63-1 therefore is aligned substantially flush with the beam side faces 48-1 while the interior panel surface 64-1 is spaced outwardly from the uprights 19-1 to define the passages 66-1 therebetween. Additionally, the upper and lower edges of the cover panels 23-1 are vertically spaced from the upper and lower beam walls 46-1 and 47-1 or the lower cross rails 43-1 to define gaps 67-1 therebetween. Such gaps 67-1 extend longitudinally along the length of each base panel 17 and provide access to the respective upper and lower raceways 21-1 and 22-1 to permit entry and exit of cabling therethrough as discussed above. Since the upper cover panels 23-1 are connected directly to the upper cross rail 42-1, no gaps 67-1 are present therebetween although it should be understood that spring clips 135 could be connected to the uprights 19-1 to replace the mounting clips 135' thereby permitting the formation of gap 67-1 therebetween.

Figure 9:
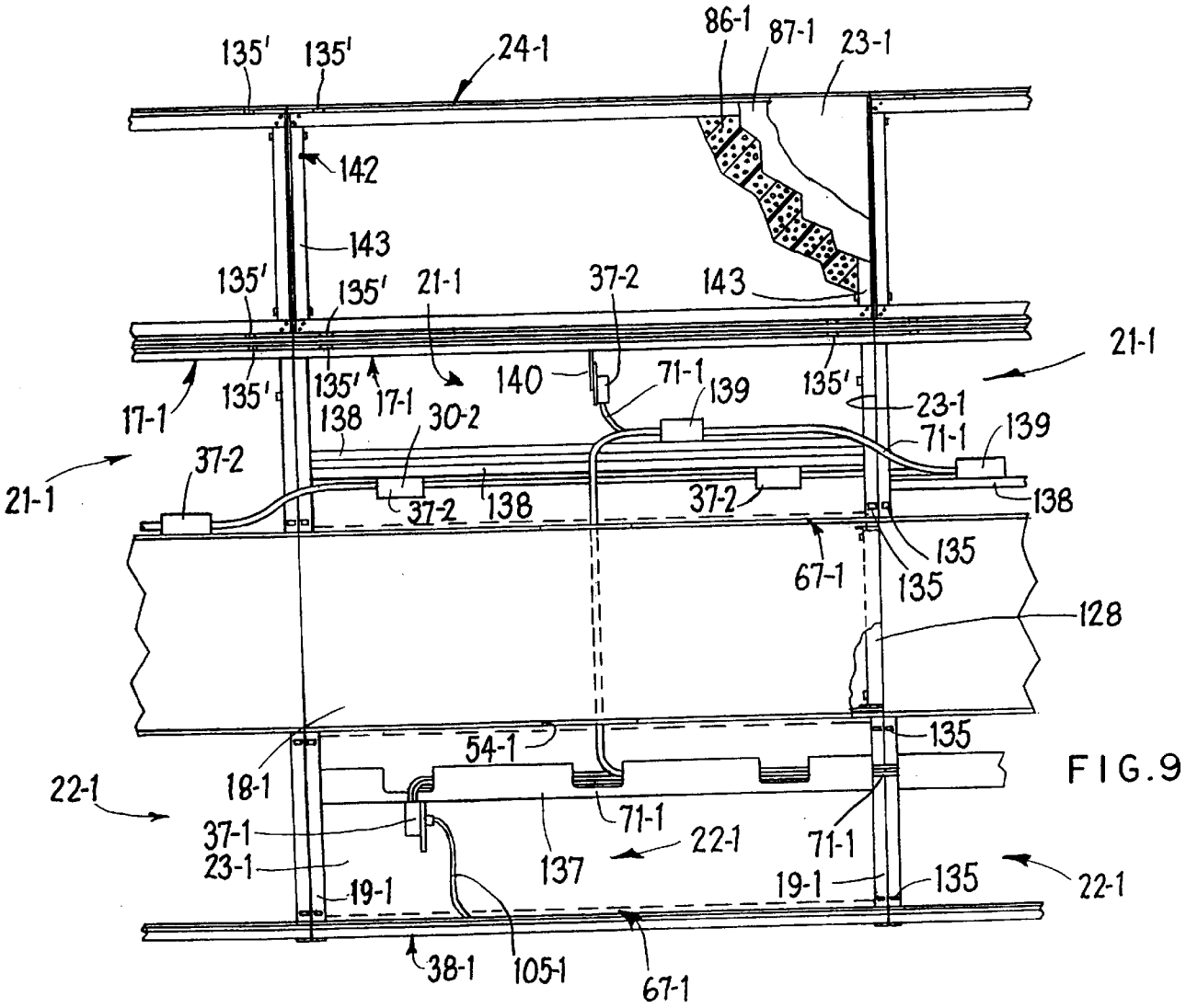
FIG. 9 is a partial front elevational view of the space-dividing wall panel system of FIG. 8 illustrating one arrangement of cabling therein.
Figure 10:
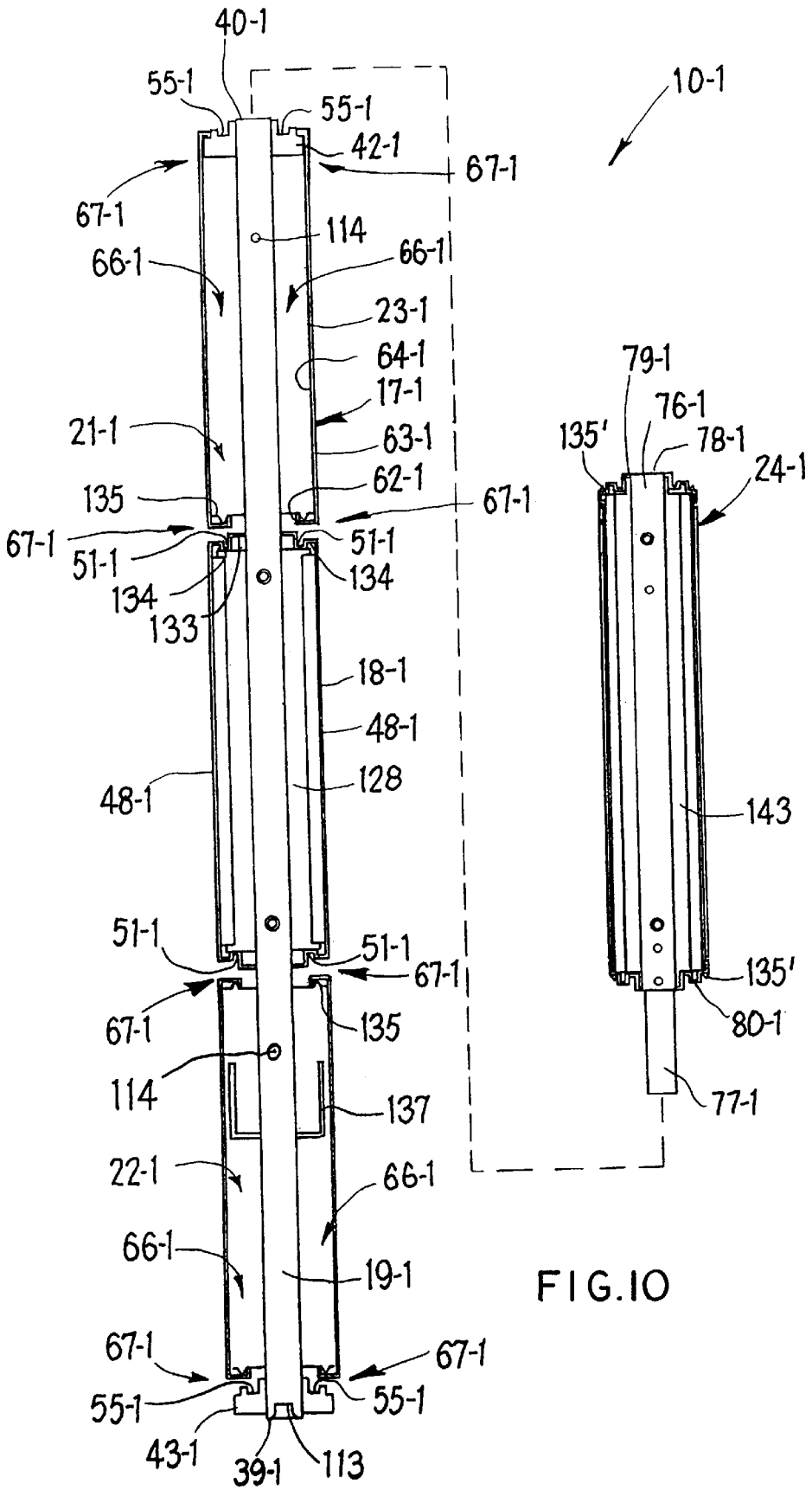
FIG. 10 is a side elevational view of one wall panel assembly of the embodiment illustrated in FIG. 8.

More particularly with respect to the cabling, the base panel 17-1 permits a variety of configurations for the cabling, one of which is illustrated in FIG. 9. The cabling arrangement illustrated in FIG. 9 uses fixed structural members as well as fixed receptacles and junction boxes connected thereto. More particularly, an elongate U-shaped cable trough 137 is illustrated in the lower raceway 22-1, which cable trough 137 has the opposite ends thereof connected to the vertical uprights 19-1. The cable troughs 137 have a width substantially the same as the thickness of the box-beam 18-1 such that the open ends of the cable trough 137 extend outwardly beyond the uprights 19-1 so as to permit the cabling 171-1 to exit the open ends of the cable trough 137 and pass around the outside of the uprights 19-1. Additionally, the cable trough 137 permits the connection of, for example, a communication receptacle 37-1 which is connected to and projects downwardly from a bottom surface of the cable trough 137. Thus, cabling 105-1 can be connected thereto and exit the base panel 17-1 through the lowermost gap 67-1 (FIG. 10). While the communications receptacle 37-1 is fully enclosed within the raceway 22-1 such that connection of electrified office equipment occurs entirely within the confines of the base panel 17-1, it should also be understood that the receptacle 37-1 could also be connected to the cable trough 137 so as to project sidewardly through an appropriate port formed in the cover panel 23-1 and permit connection from the exterior of the base panel 17-1.

Still further, a plurality of horizontally elongate tubular support members 138 are similarly connected to the uprights 19-1, for example, in the upper raceway 21-1. The support members 138 permit the connection of fixed receptacles 37-2 or junction boxes 139 thereto. The cabling 71-1 connecting the various receptacles 37-1 and 37-2 and the junction boxes 139 can take the form of conduit-protected cables, flex-cable or flexible wiring as will be understood by the skilled artisan. In all instances, the cabling 71-1 extends horizontally between serially-adjacent base panels 17-1 by being laid over the uprights 19-1 as permitted by the passages 66-1 formed between the uprights 19-1 and the interior surfaces 64-1 of the cover panels 23-1.

It is also possible to connect the receptacles 37-1 and 37-2 or the junction boxes 139 directly to the frame 38-1. For example, vertical support brackets or standoffs could be used. As shown in FIG. 9, one standoff 140 can be slidably connected to the frame 38-1 through an elongate slot formed in the cross rail 42-1 or other frame structures to permit lateral adjustment of the receptacle position. The standoff 140 also has a telescoping or adjustable length to vertically relocate the receptacle 37-2.

Figure 17A:
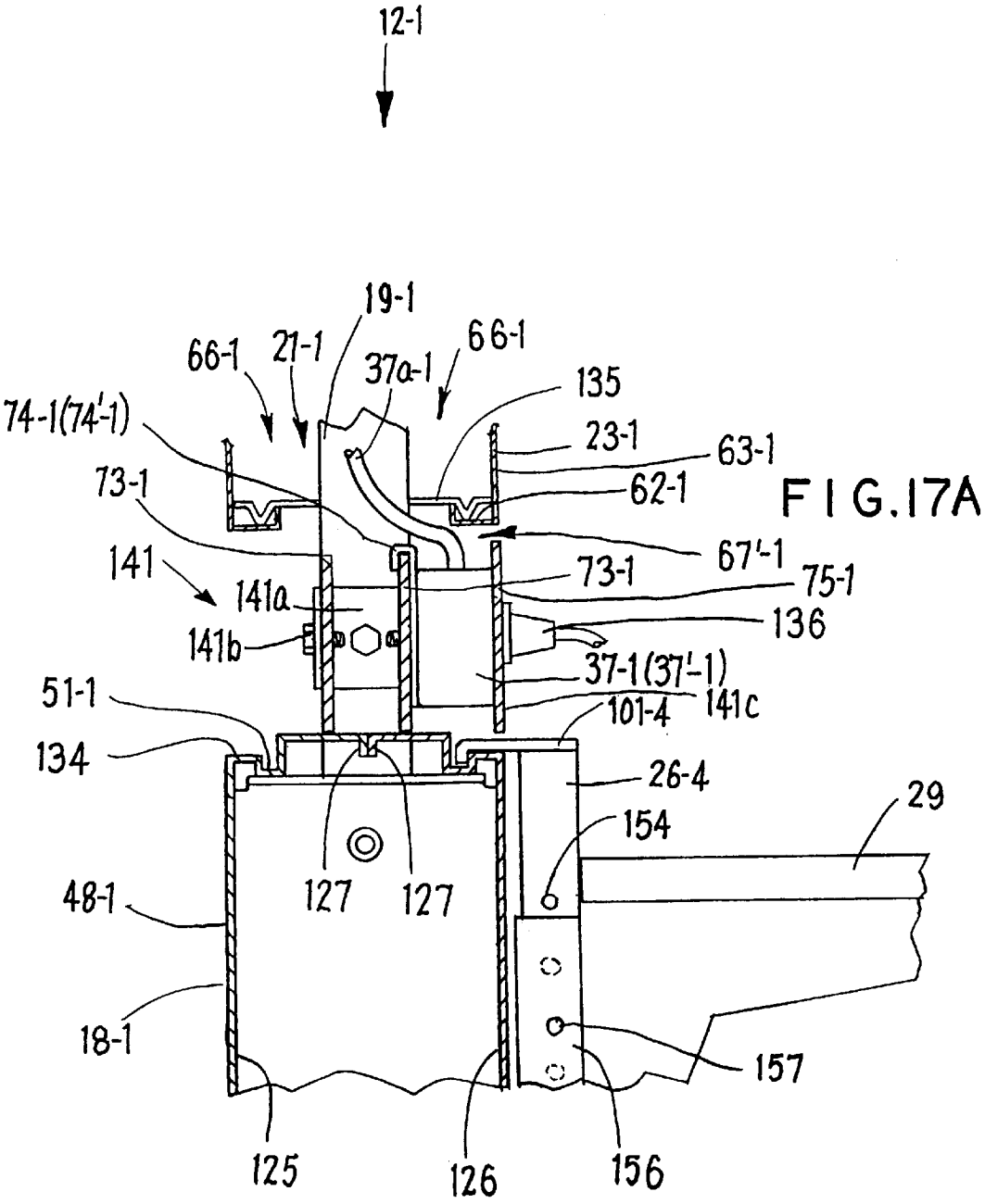
FIG. 17A is a partial side elevational view in cross-section illustrating a receptacle mounting assembly for the base panel.

Referring to FIG. 17A, the wall panel assemblies 12-1 may also include a receptacle mounting assembly 141 as generally disclosed herein with respect to the aforesaid mounting plate 73 in FIGS. 1–3. The receptacle mounting assembly 141 in the preferred embodiment as illustrated in FIG. 17A includes a parallel pair of spaced apart mounting plates or septums 73-1 which extend in a vertical plane and have their opposite ends mounted to the uprights 19-1 by a U-shaped bracket 141*a* which is fixedly secured to the mounting plates 73-1 by horizontally projecting fasteners 141*b*. The receptacle 37-1 or else the receptacle console 37'-1 includes a hook-like projection 74-1 (74'-1) along the upper edge thereof which is adapted to slide over the top edge of the mounting plate 73-1 so that the receptacle 37 is suspended therefrom. For the receptacle 37 which has a longitudinal length substantially less than the length of the gap 67'-1, the receptacle 37 can be relocated by sliding along the length of each base panel 17-1. By this arrangement, the cable 37*a*-1 which supplies the receptacle 37-1 can be routed into the upper raceway 21-1 since the cover tile 23-1 is spaced outwardly from the uprights 19-1 and the gap 67'-1 thereby opens vertically into the raceway 21-1. Additionally, an appropriate elongate rectangular plate 75-1 overlies and substantially encloses the gap 67'. This cover plate can either be a fixed front plate of the receptacle console 37'-1 or may be a removable plate which has either preformed ports therethrough or removable knockouts which permit the formation of openings through which the receptacle 37-1 passes. The receptacles 37-1 and 37'-1 are thereby accessible from the exterior of the base panel 17-1 so that suitable cable plugs 136 for office equipment (not illustrated) can be connected thereto.

Figure 17B:
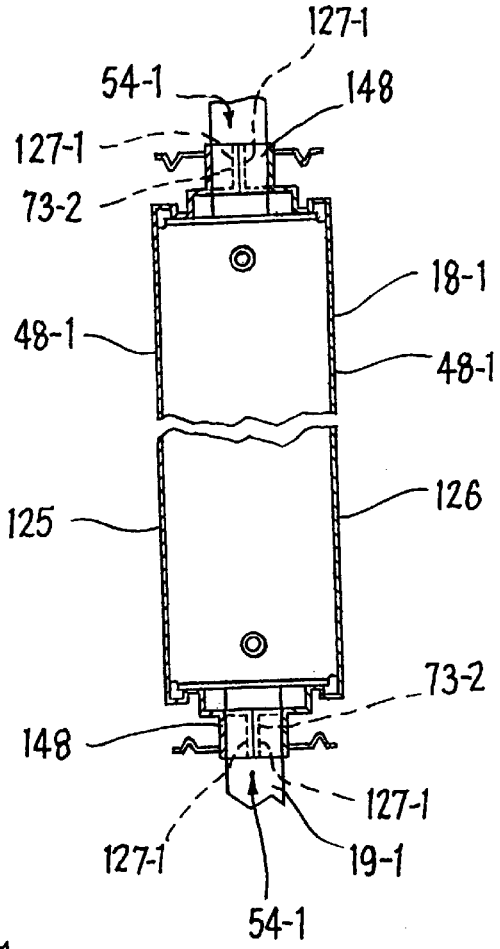
FIG. 17B is a partial side cross-sectional view illustrating the box-beam of FIG. 15A with upper and lower septums.
Figure 17C:
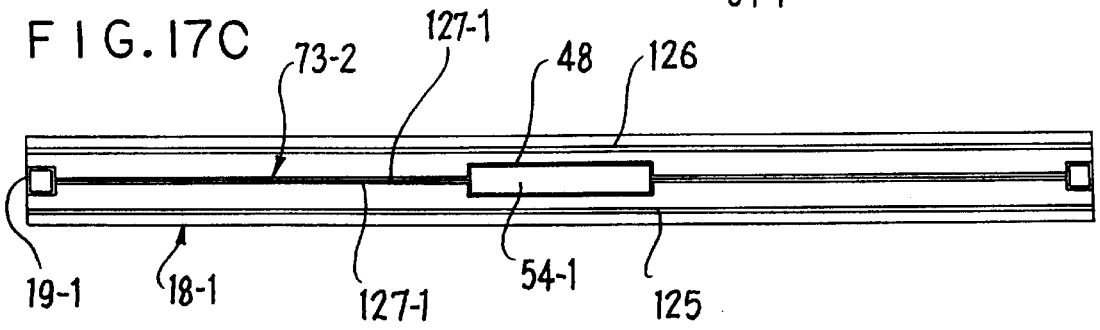
FIG. 17C is a top plan view in cross-section of the box-beam of FIG. 17B.

In another preferred embodiment as seen in FIG. 17B, a central plate or septum 73-2 substantially the same as the plate 73 (FIGS. 1–3) can be formed integral with the metal box-beam 18-1. To form the plate 73-2, the beam halves 125 and 126 are formed with upwardly extending enlarged flanges 127-1 instead of the connector flanges 127 to thereby define the septum 73-2 along the top and bottom walls of the beam 18-1. The flanges 127-1 also extend around the periphery of the cable passage 54-1 to define a duct-like extension 148 for the passage 54-1 (FIGS. 17B and 17C).

Referring to FIGS. 9, 10, 13 and 16, the extension panels 24-1 are mountable to individual base panels 17-1 so as to effect modular adjustment of the height of the wall panel assemblies 12-1. More particularly, each extension panel 24-1 includes laterally spaced vertical uprights 76-1 which define the vertical height of the extension panel 24-1. Each upright 76-1 further includes a downwardly projecting bayonet connector or stake 77-1 which is fixedly secured within the lower open end of the upright 76-1. The bayonet connector 77-1 (FIG. 16) preferably is formed of C-shaped channel which is adapted to slidably and securely seat within the open upper end 40-1 of the base panel uprights 19-1. The upright 76-1 further includes an open upper end 78-1 which allows for the connection of additional tiers of extension panels 24-1 on each lower tier of extension panels 24-1.

Each extension panel 24-1 further includes upper and lower cross rails 79-1 and 80-1 which are vertically spaced one from the other and securely formed into a rectangular frame 142 by a pair of vertically extending elongate frame members 143. The rectangular frame 142 thereby is notched at the opposite ends thereof and is fixedly connected to the uprights 76-1 preferably by welding or other suitable fastening methods.

Figure 15A:
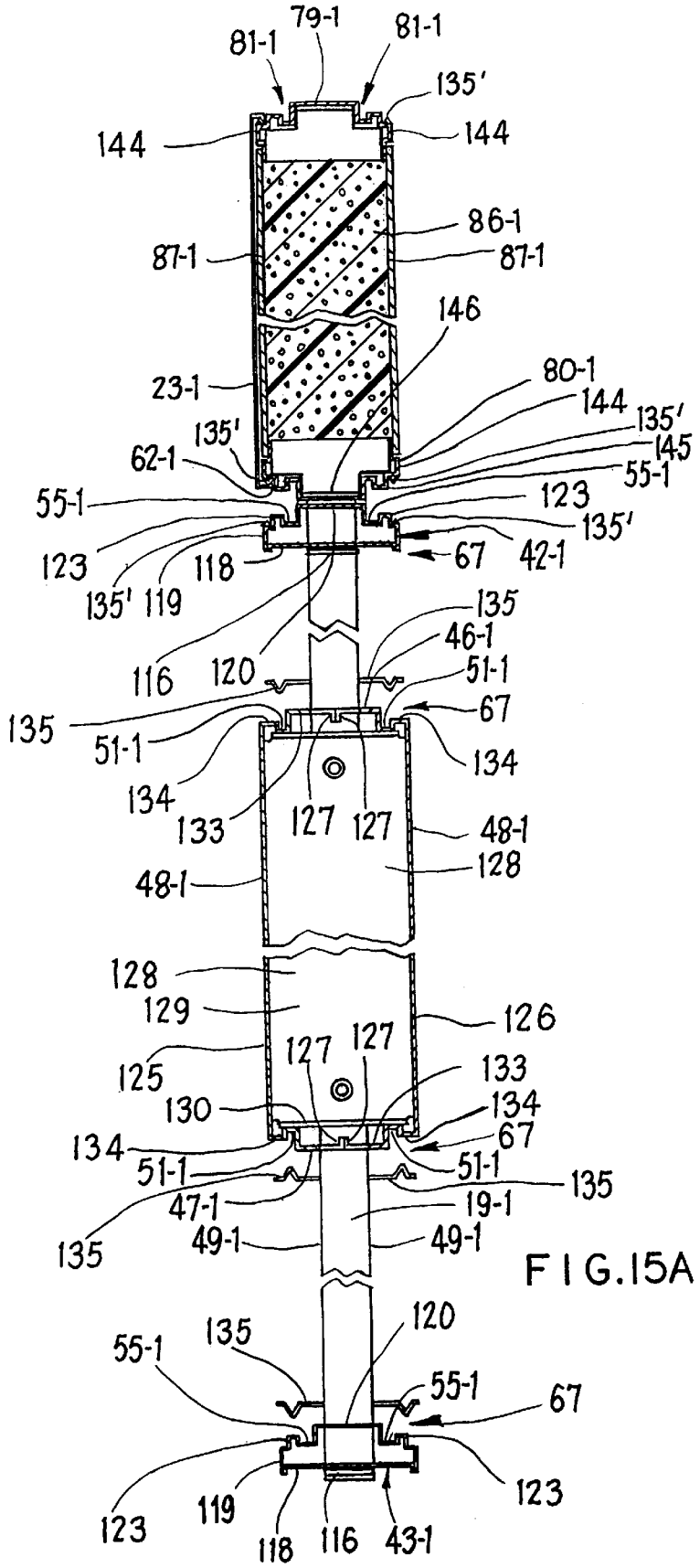
FIG. 15A is a side cross-sectional view of the wall panel assembly as viewed in the direction of arrows 15A—15A in FIG. 8.
Figure 15B:
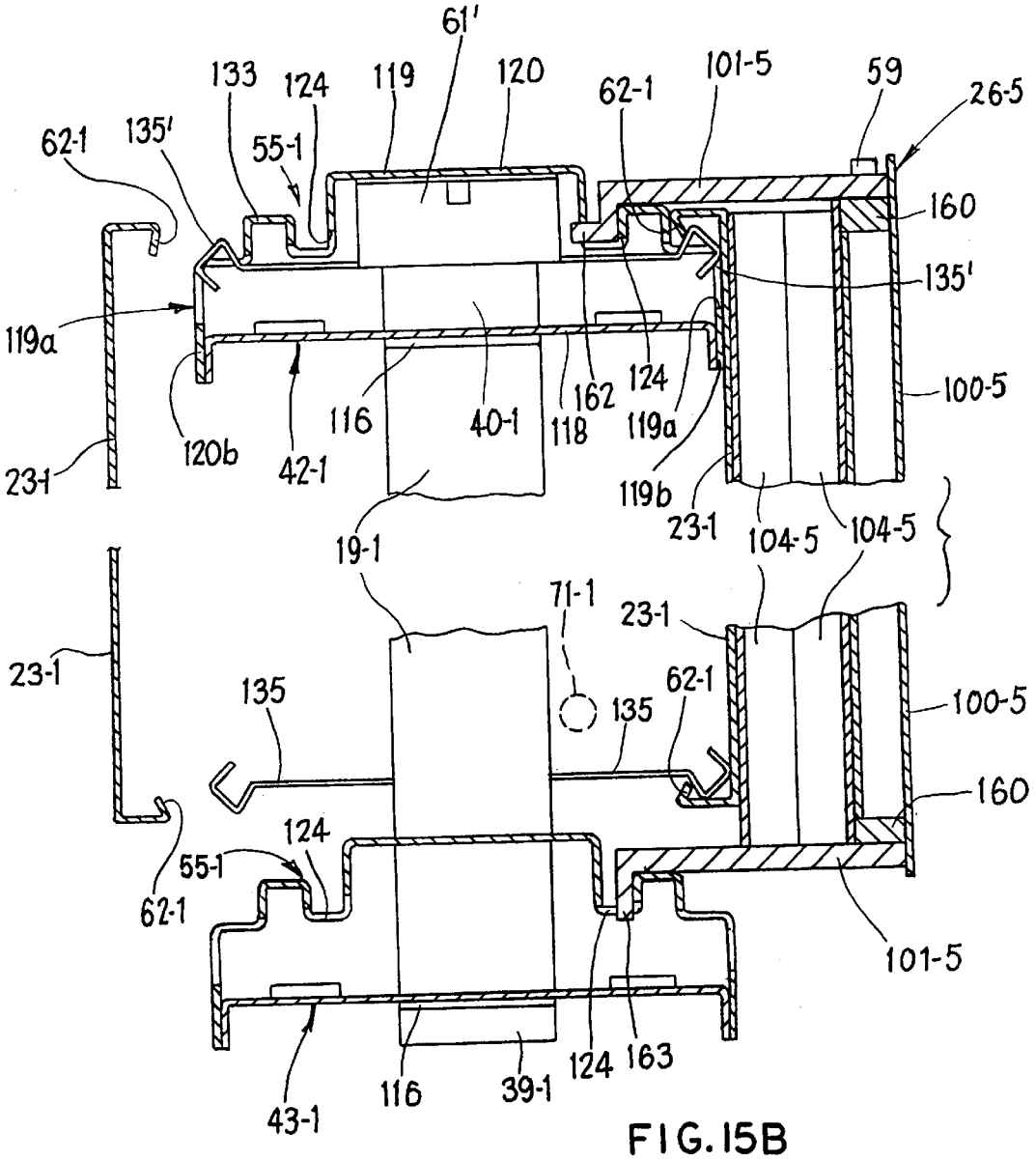
FIG. 15B is an enlarged side cross-sectional view illustrating a top cross rail having cover panels attached thereto.
Figure 15C:
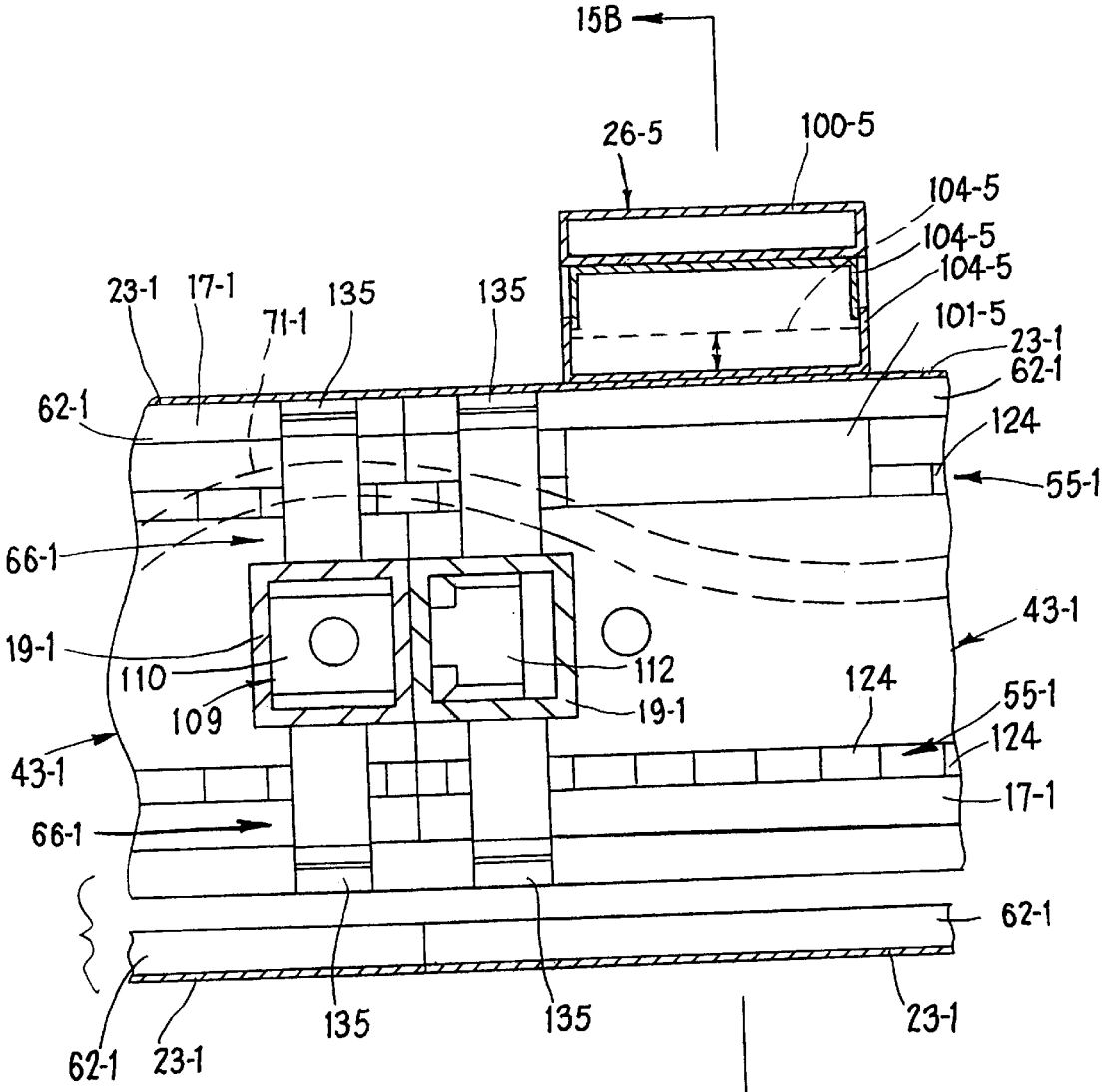
FIG. 15C is a top plan view in cross-section as viewed in the direction of arrows 15C—15C of FIG. 15B.
Figure 16:
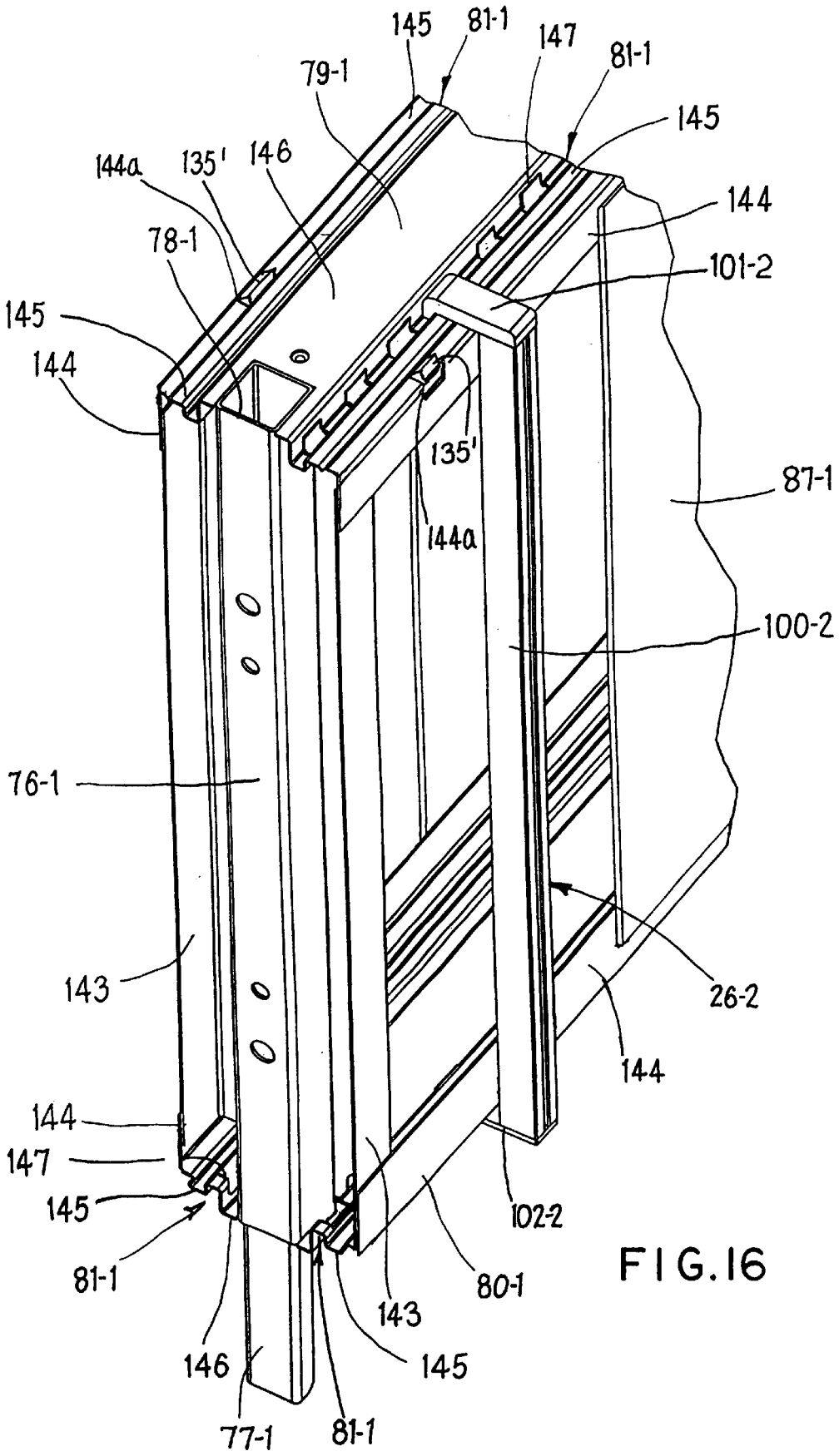
FIG. 16 is a partial perspective view of the extension panel.

The upper and lower cross rails 79-1 and 80-1 preferably have the same construction and more particularly, are formed of sheet metal into a generally U-shaped configuration as seen in FIGS. 15 and 16. Each cross rail 79-1 or 80-1 includes vertically extending side walls 144 which extend upwardly and are bent to form a stepped portion 145 to define a front channel wall. The cross rails 79-1 and 80-1 also include laterally extending elongate channels 81-1, the back wall of which is formed by a central section 146 which projects vertically above the front channel walls 145. The channels 81-1 open from the opposite ends thereof and communicate with serially adjacent channels 81-1 to define the tracks 83-1 which extend longitudinally along the length of the spine wall 14-1.

When the extension panel 24-1 is seated on the base panel 17-1 as seen in FIG. 15A, the central section 146 is disposed closely adjacent the opposing central section 120 of the upper cross rail 42-1. The central sections 120 and 146 similarly project vertically above the respective stepped portions 134 and 145 of the channels 51-1 and 81-1 so that the stepped portions 134 and 145 are vertically spaced apart and a sideward opening space is formed therebetween which permits access to the channels 51-1 and 81-1.

Preferably, each channel 81-1 further includes a plurality of rectangular apertures 147 along the length thereof. The apertures 147 are formed through the bottom and back wall of the channels 81-1 as described above with respect to the apertures 124 of the channels 55-1.

Additionally, the upper and lower cross rails 79-1 and 80-1 each include apertures 144*a* which are formed substantially the same as the apertures 119*a* described above. These cross rails 79-1 and 80-1 similarly include the above-described spring clips 135' therethrough for connection of cover panels 23-1 to the opposite sides of the extension panel 24-1 (FIG. 15A).

To increase the structural strength of the illustrated extension panel 24-1, a core 86-1 (FIG. 15A) is disposed within the open interior of the extension panel 24-1 which further includes planar skins 87-1 that fully enclose the opposite sides thereof. The core 86-1 preferably is styrofoam while the planar skins 87-1 preferably are formed of a hardboard which is secured to the frame 142 by suitable adhesives or other fastening methods. Additional pads or covers 23-1 are then mounted to the frame 142.

Figure 18:
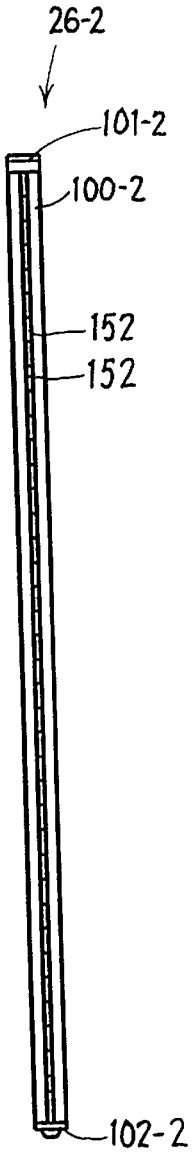
FIG. 18 is a front elevational view illustrating a first embodiment of a furniture component connector bracket.

To effect connection of the furniture components 25 to the spine wall 14-1, a plurality of embodiments for connector brackets 26 are illustrated in FIGS. 18–21. More particularly, FIG. 18 illustrates one connector bracket 26-2 which is illustrated in position on one of the extension panels 24-1 in FIG. 16. Referring to FIGS. 16 and 17, the connector bracket 26-2 includes a vertical rail 100-2 having a downwardly, extending hook-like projection or plate 101-2 connected to an upper end thereof which is hooked into one of the channels 51-1, 55-1 or 81-1 such as the channel 81-1 of the extension panel 24-1. The opposite lower end of the rail 100-2 includes an anti-dislodgement member 102-2 which is substantially similar to the projection 101-1 in that it includes an upwardly projecting hook or flange which seats within the channel 81-1 formed in the lower cross rail 80-1 so that the connector bracket 26-2 is positively engaged with the extension panel 24-1 as seen in FIG. 16. The connector bracket 26-2 in an identical manner can be connected to the box-beam 18-1 and in particular, to the upper and lower channels 51-1 thereof. Alternatively, the anti-dislodgement member 102-2 also could be eliminated or provided with an alternate construction so that the connector bracket 26-2 hangs from any one of the channels 51-1, 55-1 or 81-1. In either variation, the connector bracket 26-2 does not engage the apertures 124 or 147 formed in the respective channels 55-1 or 81-1 such that the connector bracket 26-2 is readily slidable along each channel 51-1, 55-1 or 81-1 and in particular along the continuous, uninterrupted tracks 53, 58 or 83 of the wall panel assemblies 12.

The connector bracket 26-2 further includes a vertically extending row of apertures 152 which open outwardly from the connector bracket 26-2 when mounted to a wall panel assembly 12, which apertures 152 engage hook-like projections (not illustrated) of the furniture components 25, which hook-like projections are of a known construction sold by assignee and are not believed to require further discussion herein. By providing two laterally spaced connector brackets 26-2, or any other suitable number thereof, the furniture components 25 are then hung from the spine wall 14-1.

Figure 19:
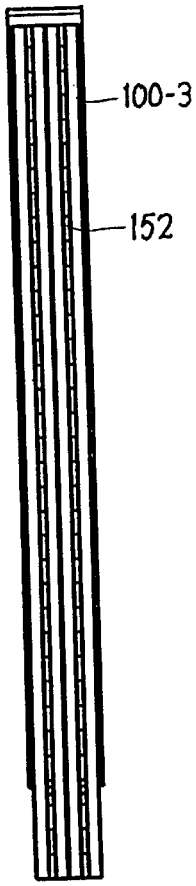
FIG. 19 is a front elevational view illustrating a second embodiment of a furniture component connector bracket.
Figure 20:
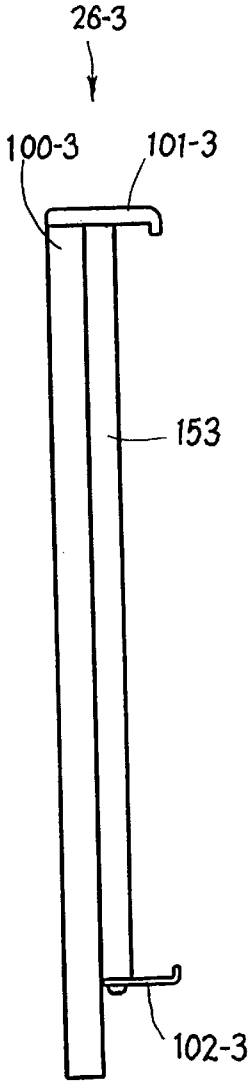
FIG. 20 is a side elevational view of the furniture component connector bracket of FIG. 19.

In the connector bracket 26-3 illustrated in FIGS. 19 and 20, a double row of apertures 152 is formed in the vertical rail 100-3. The rail 100-3 similarly includes the hook-like projection 101–3 at the upper end thereof which engages within a respective one of the channels 51-1, 55-1 or 81-1. The connector bracket 26-3 further includes the anti-dislodgement member 102-3 which is removably fastened to a vertical plate secured to an inward facing surface of the vertical rail 100-3 and engages within a downwardly opening one of the channels 51-1 or 81-1. The connector bracket 26-3 thereby accommodates two laterally adjacent furniture components 25 on a single connector bracket 26-3. More particularly, the leftward row of apertures 152 connects to one end of one furniture component 25 while the rightward row of apertures 152 connect to an end of a laterally adjacent furniture component 25. Here, two or more furniture components 25 are laterally movable in unison along the length of the spine wall.

Figure 21:
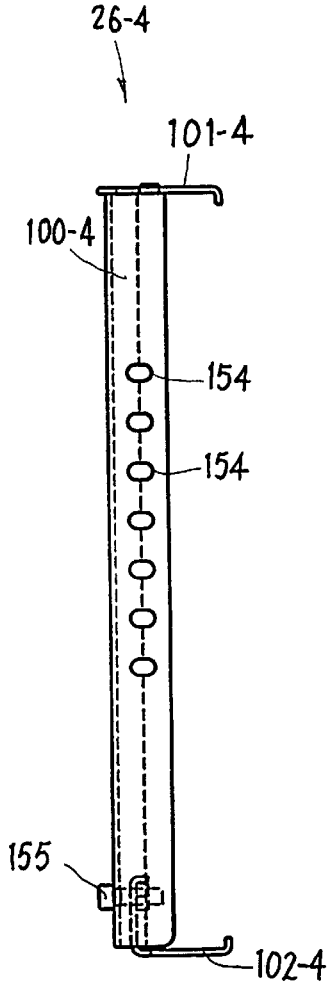
FIG. 21 is a side elevational view of a third embodiment of a furniture component connector bracket.

In FIG. 21, a further connector bracket 26-4 is illustrated which includes an upright rail 100-4 having a plurality of apertures 154 formed therethrough which are disposed in a vertically spaced apart relation. The hook-like projection 101-4 is slidably connected to the spine wall 14 as described above while the anti-dislodgement member 102-4 has an L-shape and is connectable to the rail 100-4 by a fastener 155. The connector bracket 26-4 similarly is connectable to the spine wall 14-1 as also described above. This particular connector bracket 26-4 is illustrated in position on the box-beam 18-1 so as to be slidable therealong in FIG. 27. A furniture component 25-4 such as work surface 29 is connected to the connector bracket 26-4 and in particular includes a tubular mounting section 156 which is vertically slidable along the rail 100-4. The tubular mounting section 156 is secured at a selected height by inserting a pin 157 horizontally through aligned apertures 154 so that the work surface 29 is disposed at a selected variable height.

Figure 22:
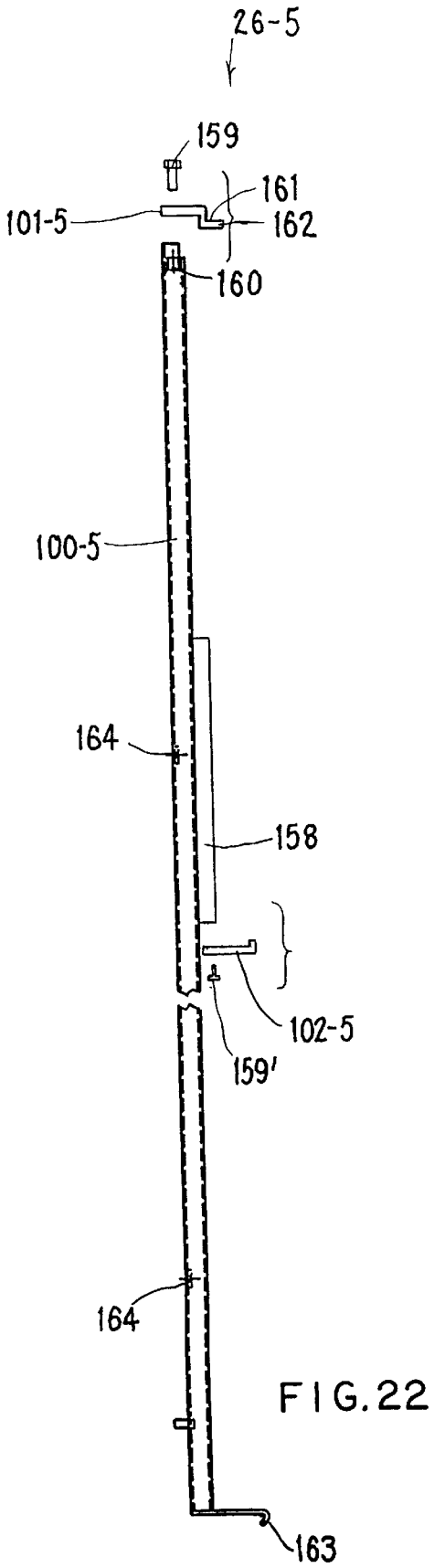
FIG. 22 is an exploded side elevational view of a fourth embodiment of a furniture component connector bracket for the connection of return walls to the space-dividing wall panel system of FIG. 8.
Figure 23:
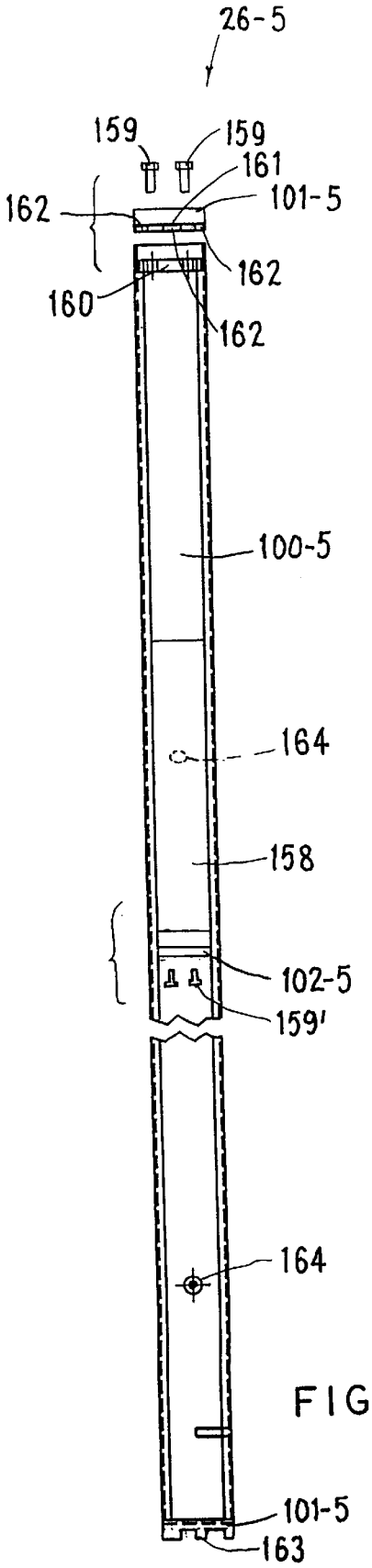
FIG. 23 is a front elevational view of the connector bracket of FIG. 22.

An additional connector bracket 26-5 is illustrated in FIGS. 22 and 23 for the mounting of the return walls 15 to the spine wall 14. In particular, the connector bracket 26-5 includes a vertical rail or interface 100-5 which has a height corresponding substantially to either the height of the base panel 17-1 alone or in combination with one extension panel 24-1. Hook-like projections 101-5 are connected to the opposite ends of the rail 100-5 and engage within the lowermost track 58-1 and the uppermost track 57-1 while a vertically elongate mounting bar 158 is mounted to the inside face of the rail 100-5 for connection of an anti-dislodgement hook-like projection 102-5.

The hook-like projection 101-5 at the upper end of the rail 100-5 is a stepped or Z-shaped bracket which is removably connected to the upper end of the rail 100-5 by fasteners 159 which threadingly engage into a corresponding plate 160 disposed at the upper end of the rail 100-5. Each of the hook-like projections 101-5 as provided at the upper and lower ends of the rail 100-5 includes laterally spaced teeth 162 and 163 respectively, which are each adapted to seat within corresponding apertures 124-1 formed in the channels 55-1. On the upper projection 101-5, the plate is stepped so to have a horizontal section 161 on which the teeth 162 are formed and which project horizontally through the back wall of the channel 55-1. The teeth 162 of the upper projection 101-5 are first inserted downwardly from above into the apertures 124-1 and then the projection 101-5 is pivoted downwardly so that the teeth 162 swing into the vertical portions of the apertures 124-1 (FIG. 15B). This is done after the lowermost projection 101-5 and attached rail 100-5 are mounted to the lowermost channel 55-1 where the teeth 163 insert downwardly into the apertures 124-1. The teeth 162 and 163 thereby prevent any lateral movement of the opposite ends of the rail 100-5 relative to the base panel 17-1. Such teeth 162 and 163 accommodate the significant torsional loads which may be applied to the return wall 15 by the furniture components mounted thereon.

Additionally, the projection 102-5 is connected to the mounting bar 158 by fasteners 159' so that the vertical leg of the projection 102-5 seats within the downward opening channel 51-1 of the lower beam wall 47-1 (FIG. 15A).

Each rail 100-5 further includes apertures 164 which are provided for the connection of a wall mounting assembly 103 (FIG. 2) for the connection of return walls 15 thereto. As described above, the wall mounting assembly 103 is provided as an adapter which connects to the particular connecting structures of a particular return wall system.

To fill the vertical gap formed between the inside face of the rail 100-5 and the outward facing surfaces of the base panel 17-1, upper and lower gap filler assemblies are mounted to the rail 100-5 above and below the mounting bar 158. Each gap filler assembly includes a nested pair of U-shaped gap-filler channels 104-5 (FIGS. 15B, 15C and FIG. 22) with one channel 104-5 fastened to the rail 100-5 and the second channel 104-5 slidably mounted over the other. The slidable channel 104-5 is movable toward the base panel 17 to fill the gap as seen in FIGS. 15A and 15B and is movable away therefrom as seen in dotted outline in FIG. 15C to permit removal of the cover panels 23-1.

Figure 24:
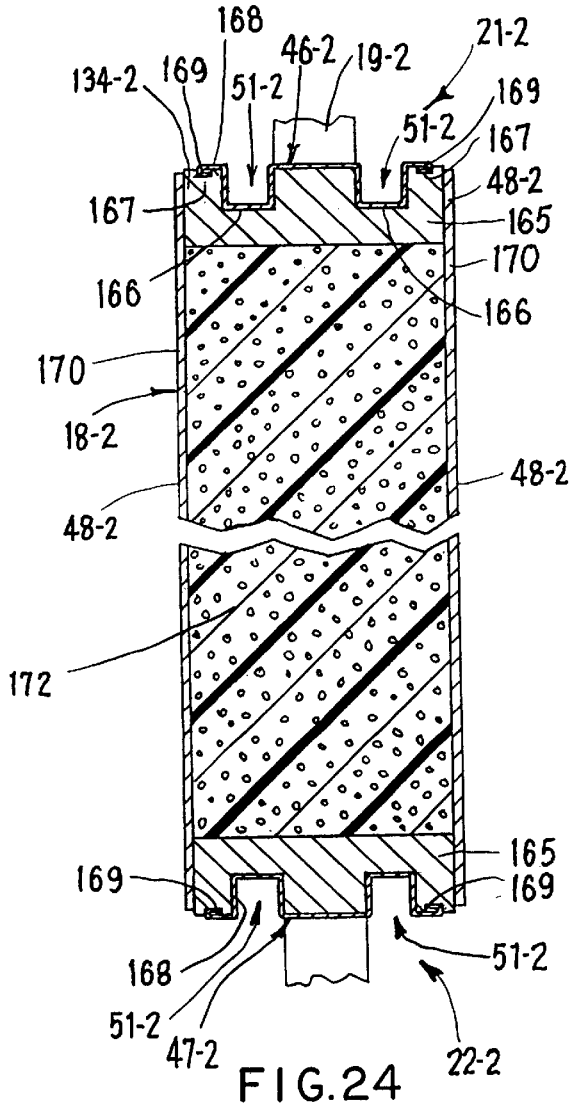
FIG. 24 is a partial side view in cross-section of an alternative construction for the box-beam of the base panel.

Referring to FIG. 24, an alternative composite construction for the box-beam 18-1 is illustrated, which construction defines a multi-component substantially solid box-beam 18-2. More particularly, the box-beam 18-2 is mountable to vertical uprights 19-2 as described above. The upper and lower beam walls 46-2 and 47-2, however, are each formed of an elongate cross member 165 which preferably is constructed of a formable or machinable material such as particle board. The cross member 165 is shaped or machined to include two spaced apart relatively deep grooves 166 corresponding to the shape of the channels 51-2 and also includes relatively shallow grooves 167 which extend along the length of the cross member 165 in the region of the front stepped portion 134-2. Additionally, the box-beam 18-2 includes an elongate metal rail 168 which is shaped so as to seat within the deep grooves 166 and thereby define the channels 51-2. The metal rail 168 includes folded over edges defining beads 169 therealong which seat within the relatively shallow grooves 167 and provide further strength to the metal rail 168. The box-beam 18-2 also includes metal or hardboard skins 170 which define the side beam faces 48-2, which skins 170 are fixedly secured to the opposing faces of the particle board cross members 165 preferably by adhesives or other suitable fastening methods. The interior of the box-beam 18-2 further includes a foam core 172 such that the box-beam 18-2 is of a substantially solid continuous construction. The box-beam 18-2, however, includes a vertical passage therethrough as described above (not illustrated in FIG. 24) so as to permit routing of cabling therethrough between the upper and lower raceways 21-2 and 22-2.

Figure 25:
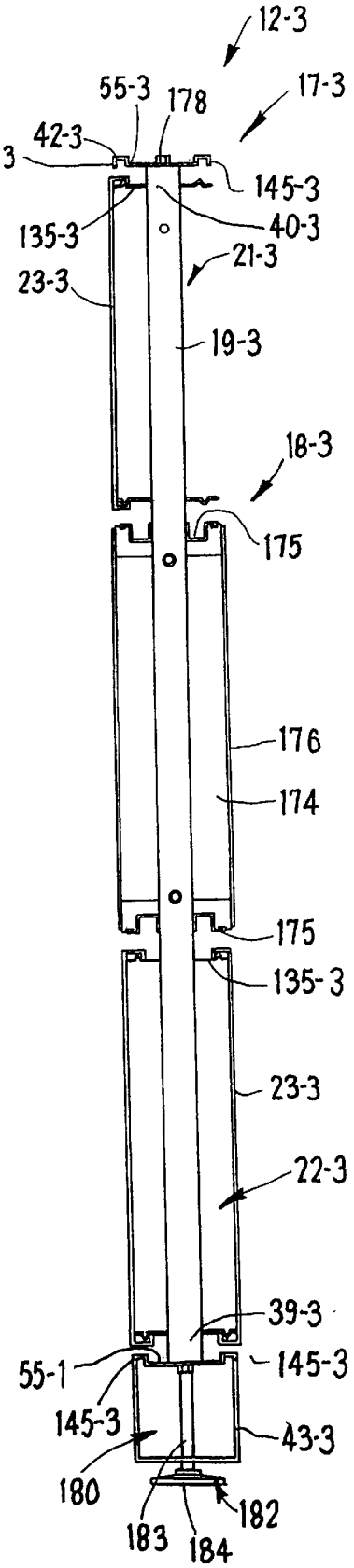
FIG. 25 is a side elevational view of an alternative embodiment of the base panel.

Still further, an additional alternative embodiment for the base panel 17-3 is illustrated in FIG. 25 which uses the beam construction described above with respect to FIG. 24. In this arrangement, the base panel 17-3 similarly includes spring clips 135-3 connected to the uprights 19-3 for the mounting of the cover panels 23-3 over the upper and lower raceways 21-3 and 22-3.

The upper cross rail 42-3, however, may be formed as an extruded or stamped metal rail which is bolted at its opposite ends to the corresponding upper free ends 40-3 of the uprights 19-3 by suitable fasteners 178. Instead of two separate spaced apart channels 55-3, a single increased width channel 55-3 can be formed as a single centrally oriented cavity within the cross rail 42-3 that is defined by stepped front walls 145-3 which extend along the length thereof. This channel 55-3, however, allows the connection of connector brackets 26 on either side of the base panel 17-3.

Also, the lower cross rail 43-3 may instead be formed as or replaced with a removable hollow substantially square tubular member which is disposed below and connects to the lower ends 39-3 of the uprights 19-3. The cross rail 43-3 thereby defines a further raceway 180 disposed below the base raceway 22-3, which raceways 22-3 and 180 are in communication one with the other by suitable vertical passages (not illustrated) formed through the top wall of the tubular cross rail 43-3. Similar to the upper cross rail 42-3, one channel 55-1 in the cross rail 43-3 is formed by a single centrally located cavity extending the length of the cross rail 43-3 whereby the channel 55-1 is defined by stepped front walls 145-3 extending along the length of the tubular cross rail 43-3. This cross rail 43-3 also can be provided only for adjustment of the height of the base panel 17-3 since the cross rail 43-3 is vertically enlarged in comparison to the previous cross rails 43, 43-1 and 43-2 discussed herein. The height-adjusting cross rail 43-3 also can be mounted to a base panel in addition to an existing cross rail 43, 43-1 or 43-2 to increase the height of the base panel.

Each lower end 39-3 of the uprights 19-3 therefore is spaced vertically above the floor and is supported in a load-bearing relation with the floor by a glide assembly 182. The glide assembly 182 includes a vertical shaft 183 threadingly engaged with the uprights 19-3 and a support foot 184 which is connected to a lower end of the shaft 183. Rotation of the shaft 183 thereby adjusts the vertical position of the foot 184 for levelling of the wall panel assemblies 12-3.

Figure 27:
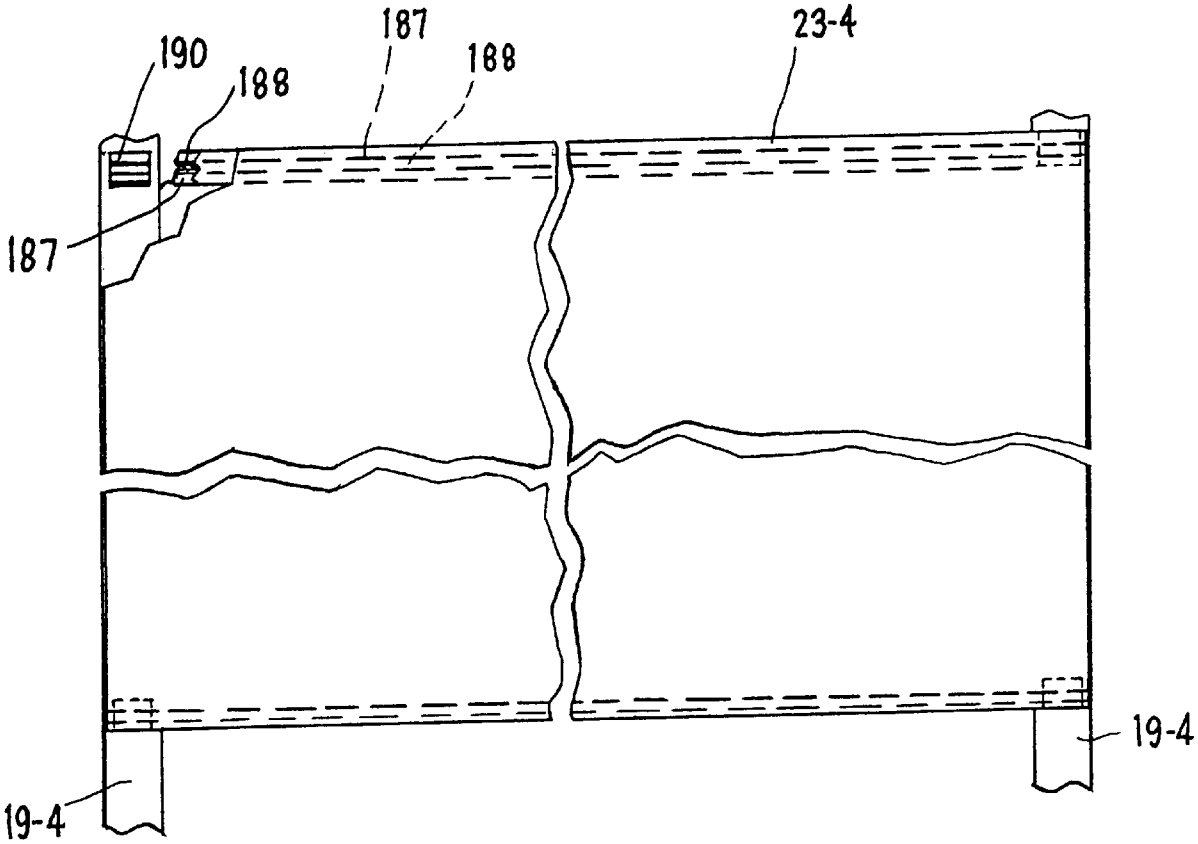
FIG. 27 is a partial front elevational view illustrating the alternative mounting structure of FIG. 26.
Figure 26:
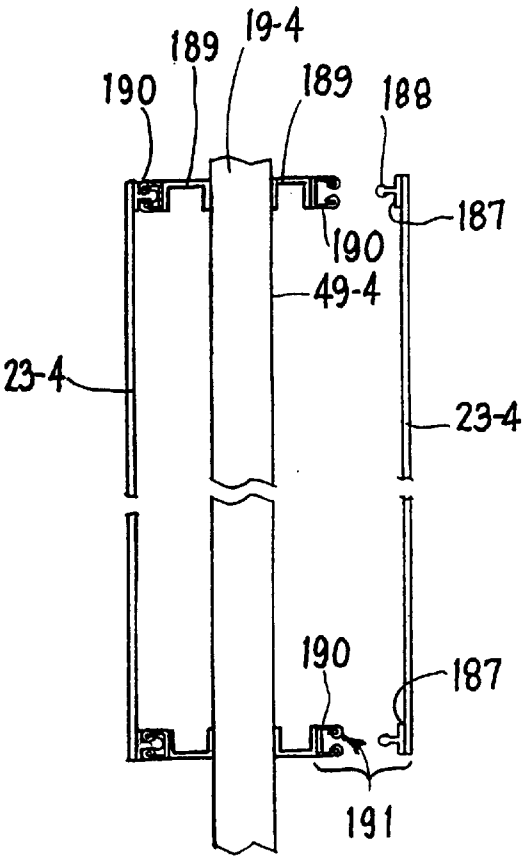
FIG. 26 is a partial side elevational view illustrating an alternative connecting structure for cover tiles.

Referring to FIGS. 26 and 27, a preferred mounting method is illustrated therein which is readily adaptable to the above-described constructions of the wall panel system 10. More particularly, the above-described cover tile 23-4 can be formed as a substantially rectangular planar panel or plate which is sufficiently rigid.

Each cover tile 23-4 further includes an elongate T-shaped bead 187 which extends laterally between the opposite ends of the cover tile 23-4 proximate the upper and lower horizontal edges thereof. More particularly, the bead 187 includes a bulbous projection 188 which extends laterally where the bead 187 preferably is formed of a resilient plastic or the like.

To connect the cover tile 23-4 to the upright 19-4, appropriate U-shaped mounting brackets 189 are connected in vertically spaced pairs to each side face 49-4 of the upright 19-4. Each mounting bracket 189 includes a resilient connector 190 having a generally U-shape and in particular, a connector opening 191 which opens towards and is adapted to tight-fittingly receive the bead 187 therein. The connector 190 preferably is similarly formed of a resilient plastic so as to permit flexing of the connector 190 upon insertion of the bulbous projection 188 therein. In accord therewith, the cover tile 23-4 is readily snapped into connection with the uprights 19-4. Preferably, the cover tile 23-4 can be formed in a single forming procedure where the upper and lower beads 187 are applied to the cover tile 23-4 during formation thereof.

Additionally, longitudinally extending interfitting alignment elements may be mounted between the opposing faces of two serially-adjacent base panels. The uprights may be laterally spaced or formed so as to be tight-fittingly engaged one with the other. For example, resilient connectors such as the interfitting connector parts 187 and 190 can be mounted vertically along the uprights 19-1.

In view of the above disclosure, the above-described features can be incorporated in various combinations into a wall panel depending upon the particular needs of a user. For example, a further preferred embodiment is illustrated in FIGS. 28–31 which provides increased electrical capacity and flexibility and increased structural strength.

More particularly, the base panel 17-5 of this embodiment uses the same basic components of a pair of vertical uprights 19-5, upper and lower cross rails 42-5 and 43-5, and a box-beam 18-5. An add-on extension panel 24-5 is mountable to the base panel 17-5 using a bayonet connection similar to that described above with respect to the embodiment of FIG. 10.

The box-beam 18-5 (FIGS. 28 and 29) in this embodiment includes a pair of horizontal U-shaped channels 196 and vertical U-shaped channels 197 that define a substantially rectangular metal frame having an interior core 198 which preferably is formed of conventional honeycomb cardboard material. The box-beam 18-5 also includes perforated metal skins or planar panels 199 covering the opposite side surfaces thereof. Additional horizontal, generally U-shaped metal cross rails 200 are fastened over the frame channels 196 to define the upper and lower beam walls 46-5 and 47-5.

Figure 31:
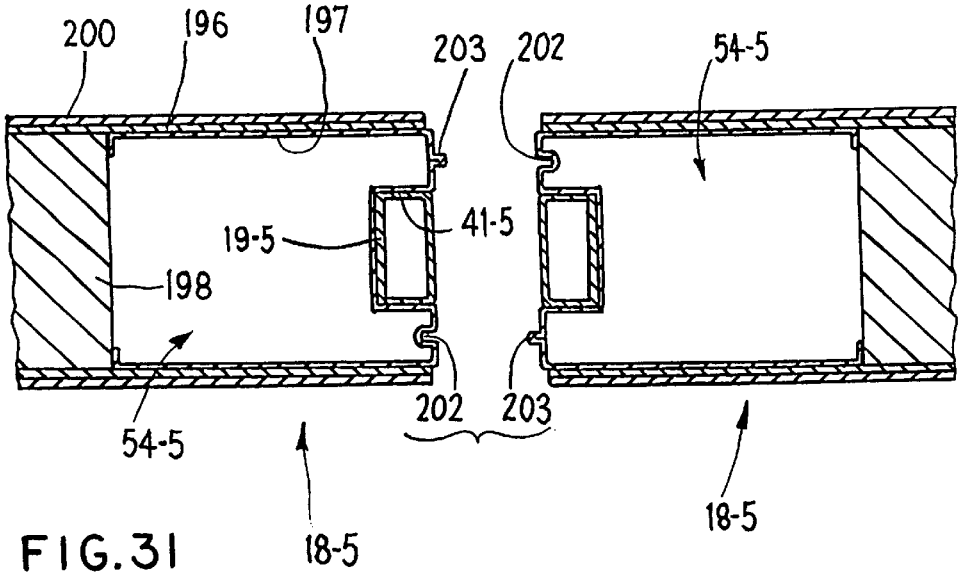
FIG. 31 is a partial top plan view in cross-section illustrating the ends of two adjacent base panels being joined together.

Each of the channels 196 and 197 and the cross rails 200 are formed with rectangular openings at the opposite ends thereof which not only permit the uprights 19-5 to pass therethrough but also define two vertical passages 54-5 at the opposite ends of the box-beam 18-5. As seen in FIG. 31, each vertical passage 54-5 is defined on three sides by the vertical channel 197 and on the fourth side by the core 198.

The uprights 19-5 are received in vertically elongate side notches 41-5 formed in the vertical channels 197 and fastened thereto. To maintain two serially-joined base panels 17-5 in alignment particularly when subjected to loads, the vertical channels 197 also include a groove 202 disposed on one side of the upright 19-5 and a rib 203 on the opposite side of the upright 19-5. The groove 202 and rib 203 extend vertically in parallel relation along the length of the box-beam 18-5 and are adapted to mate or interfit with a corresponding groove 202 and rib 203 on a serially adjacent panel. These cooperating grooves 202 and ribs 203 which are provided on both ends of each base panel serve as interfitting alignment elements for serially-connected panels.

Figure 28:
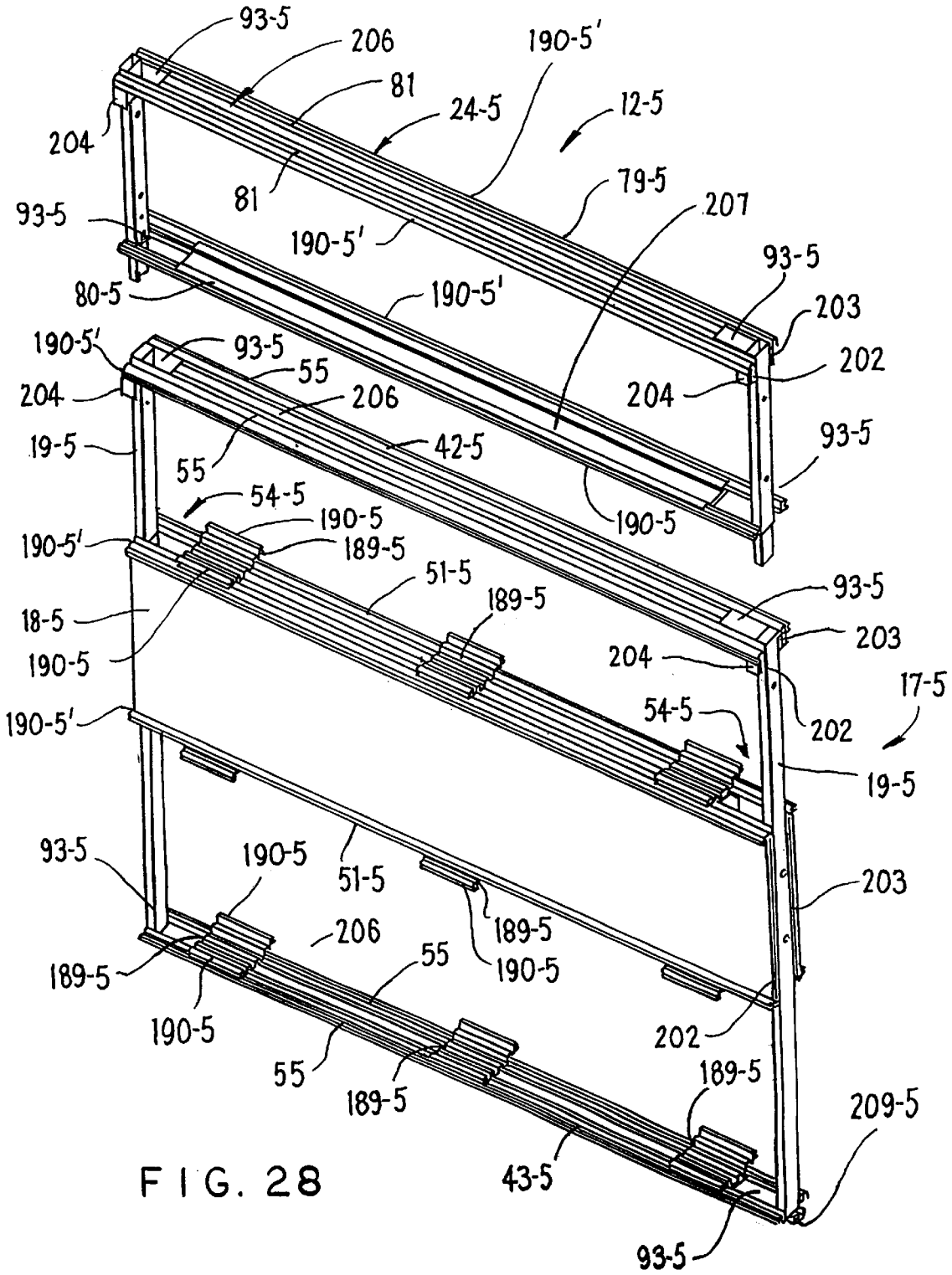
FIG. 28 is a front perspective view of a further embodiment of a wall panel assembly.
Figure 29:
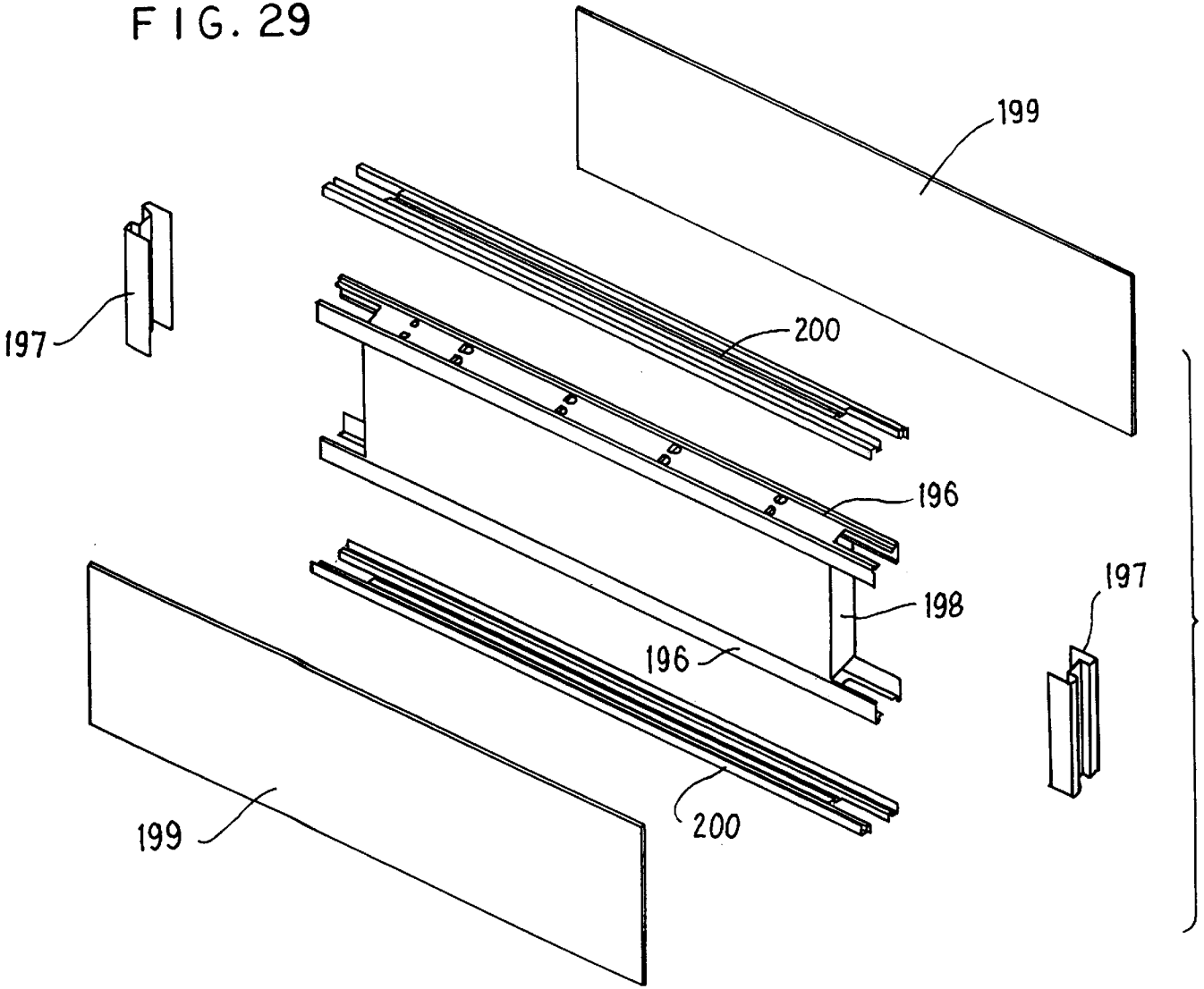
FIG. 29 is an exploded perspective view of the box-beam of the wall panel of FIG. 28.

Additional interfitting alignment elements are formed as metal brackets 204 which have substantially the same cross-sectional shape of the vertical channels 197 so as to seat over the uprights 19-5. The brackets 204 are mounted to the upper ends of the uprights 19-5 and also are provided near the upper edge of the extension panel 24-5 as seen in FIG. 28. Each bracket 204 also includes a groove 202 and rib 203 for interfitting engagement with corresponding alignment elements of an adjacent panel.

Figure 30:
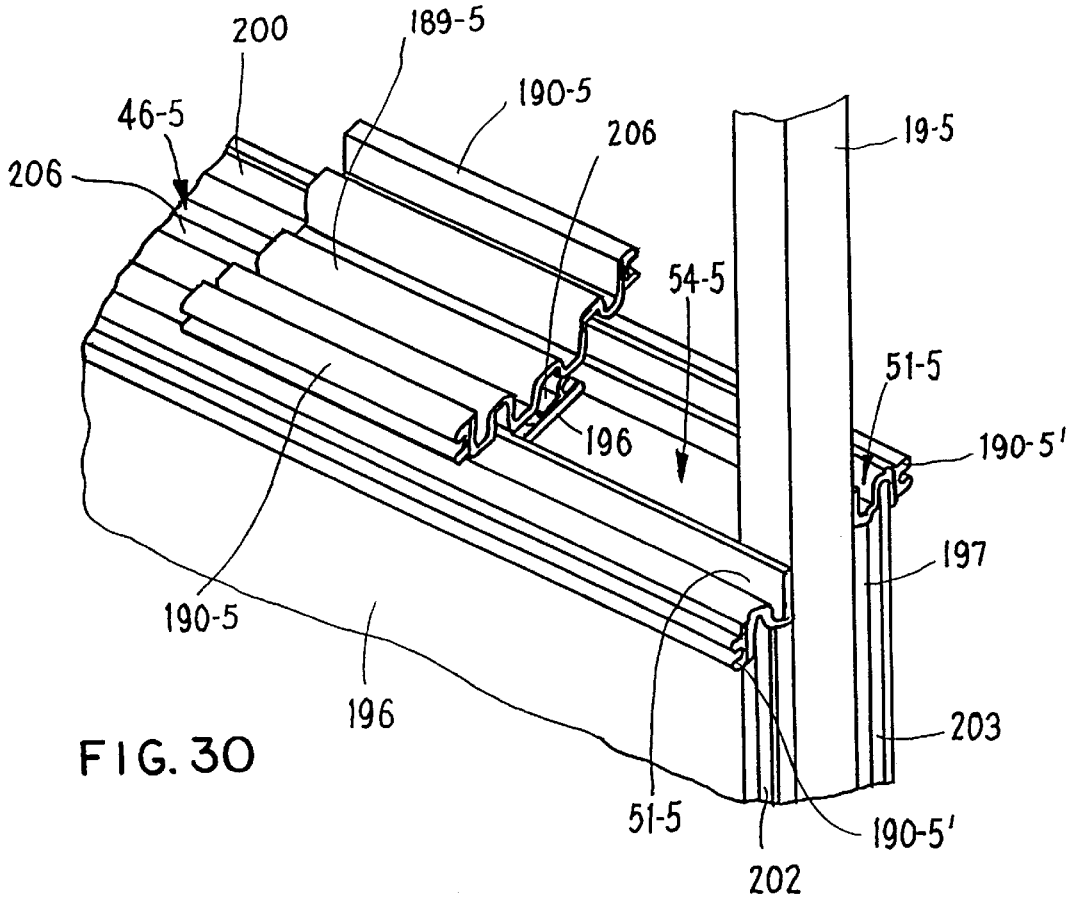
FIG. 30 is an enlarged perspective view illustrating the box-beam and a cover panel connector.

Referring to FIGS. 28 and 30, the cross rails 200 of the box-beam 18-5 are formed so as to include a pair of the channels 51-5 although an additional central channel 206 is formed therebetween. Each cross rail 200 also includes three cover pad mounting brackets 189-5 mounted thereto for connection of cover pads. The brackets 189-5 have a cross-sectional shape substantially identical to the shape of the cross rails 200 so that no interference occurs therebetween when furniture components are slid along the channels 51-5. The outside faces of the mounting brackets 189-5 include resilient U-shaped resilient connectors 190-5 for connection of cover pads using the method described above with respect to FIGS. 26 and 27. The cross rails 200 also include resilient connectors 190-5' which extend along the length thereof so that cover pads also can be attached to the box-beam 18-5. These connectors 190-5' also are provided on the cross rails 79-5, 80-5 and 42-5.

With respect to the cross rails 79-5, 80-5, 42-5 and 43-5, these rails are formed substantially the same as the cross rail 200 in that they include respective channels 81 and 55 as well as central channels 206. The central channel 206 is provided for the connection of suitable molding or the like to the uppermost edge of the wall panel which will be either the rail 42-5 or the rail 79-5. These cross rails, however, also include stiffener rails 207 fastened to the interior surface thereof which provide further rigidity thereto.

The rails 79-5, 80-5, 42-5 and 43-5 further include passages or openings 93-5 at the opposite ends thereof which are substantially similar to the vertical passages 54-5. These passages 93-5 and 54-5 thereby permit cabling to be routed throughout the base panel 17-5 as well as the extension panel 24-5. Additionally, cabling can enter or exit the wall panel assembly 12-5 through either the top or the bottom thereof. This arrangement is substantially the same as the electrical feed panel 17*a* described above with respect to FIG. 5. As can be seen, the above-described embodiment provides increased cabling capacity as well as rigidity due to the additional passages 93-5 and 54-5 and the alignment elements at the opposite ends of the panels.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a space-dividing wall panel which is adapted to be supported on a floor, said wall panel having a rigid frame that includes vertical frame rails which are laterally spaced apart and horizontal frame rails which extend between said vertical frame rails and are vertically spaced apart, said horizontal and vertical frame rails defining an open interior therebetween, said wall panel further including horizontally enlarged cover panels which are supported on said frame and overlie said open interior and a receptacle for power and/or telecommunications, the improvement comprising a support member which is disposed in said hollow interior for supporting said receptacle, said support member being supported on said frame and being disposed in said hollow interior between said horizontal frame rails, said support member defining a horizontally elongate upper edge which extends laterally and is spaced vertically from said horizontal frame rails, said receptacle including a hanger which is supported vertically by said upper edge and is slidable laterally therealong to permit repositioning of said receptacle along the length of said upper edge.

2. The wall panel according to claim 1, wherein said cover panels define at least one laterally elongate open area extending horizontally through said wall panel, said support member being a vertically enlarged septum and having a connector bracket at each end thereof, said connector brackets being connected to said vertical frame rails such that said septum is suspended therefrom and is disposed in a respective one of said open areas to block off said open area.

3. The wall panel according to claim 1, wherein said cover tiles are positioned vertically above and below said support member.

4. The wall panel according to claim 3, wherein said cover tiles are vertically spaced apart to define an open area which extends horizontally through said wall panel, said support member being a vertically enlarged septum which is disposed in said open area and blocks off said open area.

5. The wall panel according to claim 1, wherein said wall panel includes a support bracket which is connected to said frame and supports at least two said support members thereon, said support members being horizontally spaced apart on opposite sides of said wall panel, said receptacle being mountable to any one of said support members to provide access to said receptacle from either of said sides of said wall panel.

6. The wall panel according to claim 5, wherein said support members are vertically enlarged plates which are disposed in parallel relation and define exposed surfaces of said wall panel.

7. The wall panel according to claim 6, wherein said exposed surfaces are spaced inwardly of said cover panels.

8. The wall panel according to claim 1, wherein said support member is disposed proximate to a work surface height.

9. In a space-dividing wall panel which is adapted to be supported on a floor, said wall panel having a rigid frame that includes spaced apart frame sections which define an open interior, said wall panel further including horizontally enlarged cover panels which are supported on said frame and overlie said open interior, and a receptacle for power and/or telecommunications, said wall panel having a panel height defined by a plurality of modular panel areas which are disposed one above the other and have substantially equal modular heights, said cover panels overlying said modular panel areas, comprising the improvement wherein at least one of said modular panel areas includes a support member which is supported on said frame and defines a horizontally elongate member edge that extends laterally, said cover panels including a first cover panel which overlies said one modular panel area, said first cover panel having a height which is less than said modular height such that a receptacle-receiving gap is defined along an edge of said first cover panel, said gap being horizontally elongate and disposed adjacent to said support member, and said receptacle being movably supported on said member edge such that said receptacle is movable horizontally within said gap.

10. The wall panel according to claim 9, wherein a plurality of said first cover panels are provided to define a plurality of said receptacle-receiving gaps.

11. The wall panel according to claim 10, wherein said cover panels include a second cover panel having a height which corresponds to said modular height and is greater than said first cover panel, said second cover panel overlying another of said modular panel areas, and said receptacle-receiving gap being defined vertically between said first and second cover panels.

12. The wall panel according to claim 9, wherein said first cover panel includes upper and lower edges which extend horizontally, said receptacle-receiving gap extending horizontally along one of said upper and lower edges.

13. The wall panel according to claim 12, wherein said receptacle-receiving gap extends along a length of said wall panel.

14. The wall panel according to claim 9, wherein said support member has opposite ends which are supported on a laterally spaced apart pair of said frame sections.

15. The wall panel according to claim 14, wherein said support member is defined by at least one vertically enlarged plate wherein an upper section of said plate defines said member edge.

16. The wall panel according to claim 9, wherein one of said frame sections extends horizontally and includes an upstanding flange which defines said support member, other ones of said frame sections extending vertically and being rigidly connected to said horizontal frame section.

17. The wall panel according to claim 9, wherein said wall panel further includes cabling within said open interior, and said receptacle including a slide connector which is slidably connected to said support member and being connected to said cabling.

18. In a space-dividing wall panel which is adapted to be supported on a floor, said wall panel having a rigid frame that includes spaced apart frame sections which define an open interior, said wall panel further including horizontally enlarged cover panels which are supported on said frame and overlie said open interior, and a receptacle for power and/or telecommunications, comprising the improvement wherein said frame includes a furniture support arrangement which defines a plurality of furniture support locations along a lateral length of said wall panel, said frame further including a receptacle support member that defines a support section which is horizontally elongate, at least one furniture component being provided which includes a furniture connector that engages said furniture support arrangement such that said furniture component is movably supported on said wall panel and positioned at a selected one of said support locations, said receptacle including a receptacle connector which slidably engages said support section, said receptacle being slidable horizontally along said support section for positioning said receptacle at a selected location proximate to said furniture component.

19. The wall panel according to claim 18, wherein said furniture component is a work surface which is spaced vertically from the floor and said receptacle is disposed vertically above said work surface so as to be accessible therefrom.

20. The wall panel according to claim 18, wherein said furniture component is movable laterally to another of said support locations, said receptacle being slidable horizontally so as to be disposed adjacent to any one of said support locations.

* * * * *